US007813671B2

(12) United States Patent
Nittani et al.

(10) Patent No.: US 7,813,671 B2
(45) Date of Patent: Oct. 12, 2010

(54) PROCESS CARTRIDGE AND ELECTROPHOTOGRAPHIC IMAGE FORMING APPARATUS

(75) Inventors: Susumu Nittani, Suntou-gun (JP); Hideki Maeshima, Mishima (JP); Masato Tanabe, Suntou-gun (JP); Isao Koishi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 213 days.

(21) Appl. No.: 12/099,501

(22) Filed: Apr. 8, 2008

(65) Prior Publication Data

US 2008/0253803 A1 Oct. 16, 2008

(30) Foreign Application Priority Data

Apr. 10, 2007 (JP) ..... 2007-102602

(51) Int. Cl.
*G03G 21/18* (2006.01)

(52) U.S. Cl. ..... 399/113; 399/106; 399/262

(58) Field of Classification Search ..... 399/106, 399/113, 262
See application file for complete search history.

(56) References Cited

U.S. PATENT DOCUMENTS

| | | | | |
|---|---|---|---|---|
| 6,459,869 | B2 | 10/2002 | Nittani et al. | 399/111 |
| 6,463,234 | B2 | 10/2002 | Arimitsu et al. | 399/113 |
| 6,681,088 | B2 | 1/2004 | Kanno et al. | 399/111 |
| 6,834,171 | B2 | 12/2004 | Nittani et al. | 399/103 |
| 6,947,686 | B2 | 9/2005 | Kawai et al. | 399/111 |
| 6,968,142 | B2 | 11/2005 | Arimitsu et al. | 399/114 |
| 6,980,758 | B2 | 12/2005 | Murayama et al. | 399/111 |
| 7,003,247 | B2 | 2/2006 | Koishi et al. | 399/167 |
| 7,024,137 | B2 | 4/2006 | Nittani et al. | 399/222 |
| 7,027,756 | B2 | 4/2006 | Hoshi et al. | 399/111 |
| 7,046,942 | B2 | 5/2006 | Arimitsu et al. | 399/114 |
| 7,072,594 | B2 | 7/2006 | Hoshi et al. | 399/27 |
| 7,072,601 | B2 | 7/2006 | Kakitani et al. | 399/90 |
| 7,072,603 | B2 | 7/2006 | Tsuzuki et al. | 399/111 |
| 7,088,938 | B2 | 8/2006 | Hashimoto et al. | 399/103 |
| 7,088,939 | B2 | 8/2006 | Maeshima et al. | 399/111 |
| 7,127,194 | B2 | 10/2006 | Hoshi et al. | 399/111 |
| 7,139,502 | B2 | 11/2006 | Koishi et al. | 399/93 |
| 7,158,735 | B2 | 1/2007 | Murayama et al. | 399/111 |
| 7,158,749 | B2 | 1/2007 | Ueno et al. | 399/351 |
| 7,184,690 | B2 | 2/2007 | Ueno et al. | 399/117 |
| 7,194,225 | B2 * | 3/2007 | Yamaguchi | 399/111 |

(Continued)

FOREIGN PATENT DOCUMENTS

JP 2003-24195 1/2003

(Continued)

*Primary Examiner*—Constantine Hannaher
(74) *Attorney, Agent, or Firm*—Fitzpatrick, Cella, Harper & Scinto

(57) ABSTRACT

A process cartridge detachably mountable to a main assembly of an electrophotographic image forming apparatus, includes a drum unit having an electrophotographic photosensitive drum; and a developing unit rotatably connected with the drum unit at a center of rotation. The developing unit includes a developing roller for developing an electrostatic latent image formed on the electrophotographic photosensitive drum with a developer, a developer accommodating portion accommodating the developer, and a supply opening, extending in an axial direction of the developing roller, for supplying the developer to the developing roller from the developer accommodating portion. The rotation axis is within a width of the sealing member as seen in a direction perpendicular to a surface of the sealing member.

14 Claims, 24 Drawing Sheets

U.S. PATENT DOCUMENTS

| | | | | |
|---|---|---|---|---|
| 7,215,909 | B2 | 5/2007 | Nittani et al. | 399/222 |
| 7,272,339 | B2 | 9/2007 | Tsuzuki et al. | 399/111 |
| 7,315,710 | B2 | 1/2008 | Ueno et al. | 399/117 |
| 7,340,197 | B2 | 3/2008 | Murayama et al. | 399/111 |
| 7,349,649 | B2 | 3/2008 | Hoshi et al. | 399/111 |
| 2006/0051133 | A1 | 3/2006 | Koishi et al. | 399/167 |
| 2006/0067734 | A1 | 3/2006 | Igarashi et al. | 399/119 |
| 2006/0177231 | A1 | 8/2006 | Mori et al. | 399/12 |
| 2006/0245784 | A1* | 11/2006 | Tsuzuki et al. | 399/111 |
| 2006/0245785 | A1 | 11/2006 | Kawamura et al. | 399/111 |
| 2007/0160388 | A1 | 7/2007 | Yoshimura et al. | 399/111 |
| 2007/0286632 | A1* | 12/2007 | Okabe | 399/90 |
| 2008/0159774 | A1 | 7/2008 | Tanabe et al. | 399/90 |

FOREIGN PATENT DOCUMENTS

| | | |
|---|---|---|
| JP | 2003-241495 | 8/2003 |
| JP | 2006-98772 | 4/2006 |

* cited by examiner

PROCESS CARTRIDGE AND ELECTROPHOTOGRAPHIC IMAGE FORMING APPARATUS

FIELD OF THE INVENTION AND THE RELATED ART

The present invention relates to a process cartridge used by an electrophotographic copying machine, an electrophotographic printer, and the like. It also relates to an electrophotographic image forming apparatus which uses a process cartridge.

In the field of an image forming apparatus which uses an electrophotographic image forming process, it has been a common practice to employ a process cartridge system, which integrally places an electrophotographic photosensitive drum (which hereafter will be referred to as photosensitive drum), and processing means for processing the photosensitive drum, in a cartridge removably mountable in the main assembly of an image forming apparatus.

A process cartridge system makes it possible for a user to maintain an image forming apparatus by him- or herself, that is, without relying on a service person. Thus, it can drastically improve image forming operability. Therefore, a process cartridge system is widely used in the field of an electrophotographic image forming apparatus (which hereafter will be referred to simply as an image forming apparatus).

A conventional process cartridge, that is, a process cartridge in accordance with the prior art, is made up of a photosensitive drum unit and a development unit. The photosensitive drum unit has a photosensitive drum. The development unit has a development roller and a development blade. It contains toner, which is developer. The development roller is the means for developing a latent image on a photosensitive drum. The photosensitive drum unit and the development unit are connected to each other with connective means in such a manner that they are allowed to rotationally move about the connective means. The process cartridge is structured so that in an image forming operation, not only can the photosensitive drum and the development roller be kept in contact with each other, but also, a beam of light can be projected upon the peripheral surface of the photosensitive drum from an exposing means, that is, a means for forming an electrostatic latent image. Further, in order to ensure that the development roller is placed, and kept, in contact with the photosensitive drum, the process cartridge is provided with pressure application springs which keep the peripheral surface of the development roller pressed upon the peripheral surface of the photosensitive drum.

Among various types of an image forming apparatus, there is an image forming apparatus of the so-called inline type. Generally, an image forming apparatus of the inline type employs multiple process cartridges, which are for forming yellow, magenta, cyan, and black monochromatic images, one for one, and each of which has a photosensitive drum and a development unit. It forms a full-color image by placing four monochromatic images, different in color, in layers. In the case of an image forming apparatus of this type disclosed in Japanese Laid-open Patent Application 2006-98772, it is provided with a tray for supporting process cartridges. This image forming apparatus is structured so that the tray can be pulled out from the main assembly of the image forming apparatus to allow a user to replace the process cartridge in the tray.

Further, a process cartridge is provided with a sealing member which keeps toner sealed in its toner storage chamber (developer storage chamber) until the process cartridge is put to use for the first time. Thus, the sealing member has to be removed before the process cartridge is placed in an image forming apparatus to be used for the first time.

The sealing member is to be pulled out of a process cartridge through the seal member removal slot, with which one of lengthwise end walls of the development unit of the process cartridge is provided. As for the operation for removing the sealing member, a user (operator) is to pull the sealing member, while holding a process cartridge, as described in Japanese Laid-open Patent Application 2003-241495 so that the sealing member comes out of the process cartridge.

In some cases, process cartridges are installed in an image forming apparatus before the image forming apparatus is shipped out of the factory in which the image forming apparatus was assembled. This arrangement is made because pre-installing process cartridges in the image forming apparatus before the image forming apparatus is shipped out of its factory makes it easier for a user to find out the method for installing a process cartridge when the user is setting up the image forming apparatus. In other words, the pre-installation of process cartridges improves an image forming apparatus in usability. Some image forming apparatuses and process cartridges are structured so that the sealing member can be pulled out without removing the process cartridges from the main assembly of an image forming apparatus.

SUMMARY OF THE INVENTION

Some conventional process cartridges structured so that a development unit and a photosensitive drum unit can be rotationally moved relative to each other are problematic in that the development unit does not remain stable in attitude when a sealing member is pulled out.

Thus, the primary object of the present invention is to improve a process cartridge in operability, in particular, in terms of the removal of the sealing member.

Another object of the present invention is to provide a structural arrangement for a process cartridge, which makes it possible to keep the development unit of a process cartridge stable in attitude when removing the sealing member of the process cartridge while the process cartridge is not in an image forming apparatus, so that the sealing member can be properly removed.

Another object of the present invention is to provide a structural arrangement for a process cartridge, which makes it possible to keep the development unit of a process cartridge stable in attitude when removing the sealing member of the process cartridge even while the process cartridge is in an image forming apparatus, so that the sealing member can be properly removed.

According to an aspect of the present invention, there is provided a process cartridge detachably mountable to a main assembly of an electrophotographic image forming apparatus. The process cartridge comprises a drum unit having an electrophotographic photosensitive drum, and a developing unit rotatably connected with the drum unit at a center of rotation. The developing unit includes a developing roller for developing an electrostatic latent image formed on the electrophotographic photosensitive drum with a developer, a developer accommodating portion accommodating the developer, and a supply opening, extending in an axial direction of the developing roller, for supplying the developer to the developing roller from the developer accommodating portion. The rotation axis is within a width of the sealing member as seen in a direction perpendicular to a surface of the sealing member.

According to another aspect of the present invention, there is provided an electrophotographic image forming apparatus for forming an image on a recording material. The electrophotographic image forming apparatus comprises a process cartridge detachably mounted to a main assembly of the apparatus of the electrophotographic image forming apparatus. The process cartridge includes a drum unit having an electrophotographic photosensitive drum, and a developing unit rotatably connected with the drum unit at a center of rotation. The developing unit includes a developing roller for developing an electrostatic latent image formed on the electrophotographic photosensitive drum with a developer, a developer accommodating portion accommodating the developer, and a supply opening, extending in an axial direction of the developing roller, for supplying the developer to the developing roller from the developer accommodating portion. The rotation axis is within a width of the sealing member as seen in a direction perpendicular to a surface of the sealing member, The apparatus also includes means for feeding the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

General Structure of Image Forming Apparatus

Figure 1:
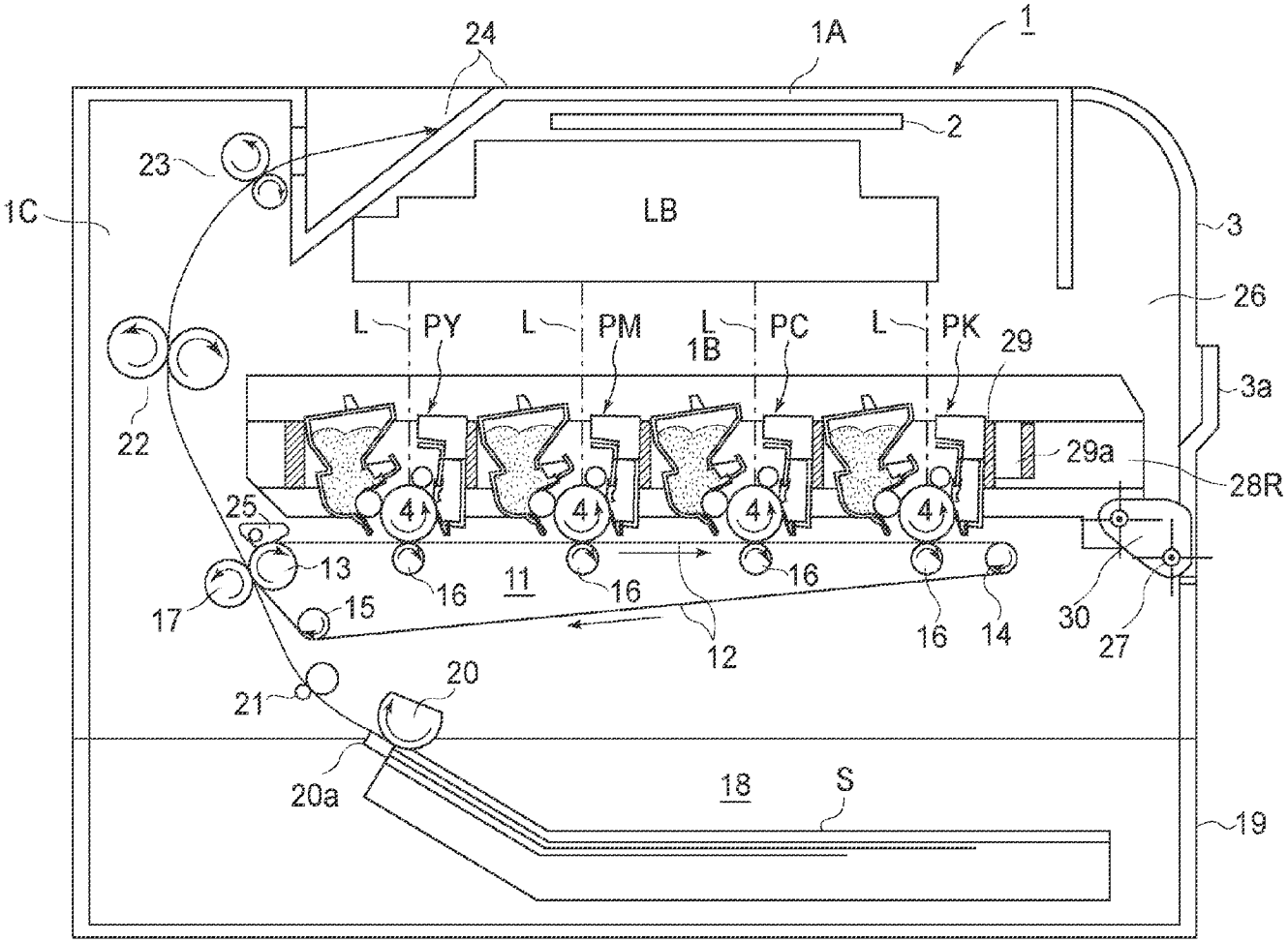
FIG. 1 is a schematic sectional view of the electrophotographic color image forming apparatus in the first embodiment of the present invention, showing the general structure of the apparatus, as seen from the left side of the apparatus.
Figure 2:
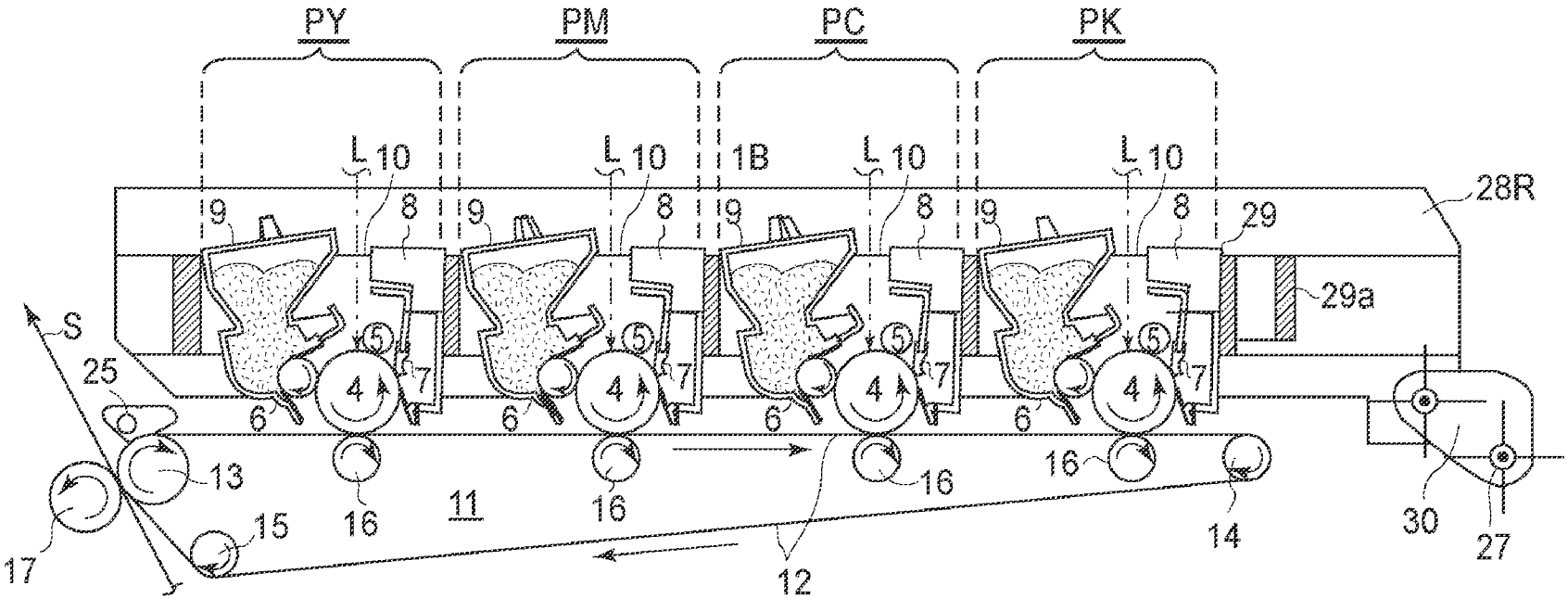
FIG. 2 is an enlarged view of a part of FIG. 1.

FIG. 1 is a schematic sectional view of the electrophotographic color image forming apparatus in the first embodiment of the present invention, showing the general structure of the apparatus, as seen from the left side of the apparatus. FIG. 2 is an enlarged view of a part of FIG. 1.

This image forming apparatus 1 is a full-color laser printer, more specifically, an image forming apparatus which uses an electrophotographic image formation process based on four primary colors. It forms a color image on a sheet of recording medium S. The image forming apparatus 1 uses process cartridges, which are removably mountable in the main assembly 1A of the image forming apparatus 1.

In the following description of the image forming apparatus 1, the front side of the image forming apparatus 1 is the side where the door 3 is located. The rear side (back side) of the image forming apparatus 1 is the opposite side from the front side. The longitudinal direction of the image forming apparatus 1 means both the rear-to-front direction (forward direction), and the opposite (rearward) direction from the rear-to-front direction of the image forming apparatus 1. The left-side and right-side of the image forming apparatus 1 are the left-side and right-side of the image forming apparatus 1 as seen from the front side. The left-and-right direction (right-and-left direction) means both the right-to-left direction (leftward direction), and the opposite (rightward) direction from the right-to-left direction. The main assembly 1A of the image forming apparatus 1 means the image forming apparatus 1 minus the process cartridges. Further, in terms of the lengthwise direction (direction parallel to axial line of photosensitive drum), the lengthwise end of a process cartridge, to which driving force is transmitted from the apparatus main assembly 1A, is referred to as the driving force transmitting end (other side), whereas the lengthwise end of the process cartridge, to which driving force is not transmitted from the apparatus main assembly 1A, is referred to as the opposite end (one side) from the driving force transmitting end.

Designated by reference 1 symbol 1B is a process cartridge bay, which is in the apparatus main assembly 1A. The process cartridge bay 1B is structured so that four process cartridges, that is, first to fourth process cartridges P (PY, PM, PC, and PK) can be horizontally juxtaposed in parallel. Structuring the process cartridge bay 1B so that the multiple process cartridges P (each of which hereinafter will be referred to simply as cartridge) are horizontally juxtaposed in parallel as described above can reduce the image forming apparatus 1 in height. The four cartridges P are the same in that they all are structured to use an electrophotographic image formation process, although they are different in the color of developer (which hereafter may be referred to as toner), and the amount of the toner therein. To the cartridges P in the process cartridge bay 1B, a rotational driving force is transmitted from the apparatus main assembly 1A. Also to the cartridges P in the process cartridge bay 1B, biases (unshown charge bias, development bias, etc.) are supplied from the apparatus main assembly 1A.

Figure 20:
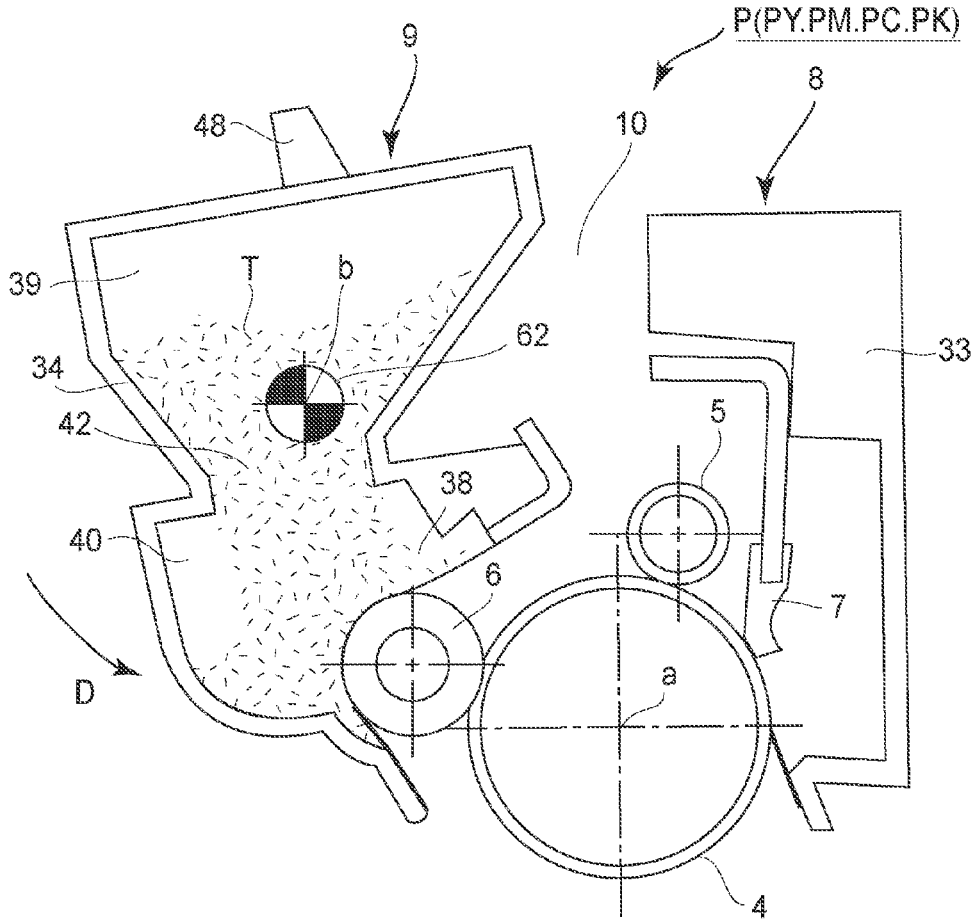
FIG. 20 is a schematic cross-sectional view of the process cartridge, the developer outlet of which has been unsealed.

Referring to FIG. 20, each cartridge P in this embodiment is made up of a photosensitive drum unit 8 (which hereafter will be referred to simply as a drum unit), and a development unit 9, which are connected to each other in such a manner that they are allowed to rotationally move relative to each other. The drum unit 8 has an electrophotographic photosensitive drum 4 (which hereafter will be referred to simply as a photosensitive drum), and processing means, more specifically, a charging means 5 and a cleaning means 7, which process the photosensitive drum 4, whereas the development unit 9 has a developing means which develops an electrostatic latent image on the photosensitive drum 4. As the charging means, a charge roller 5 is employed. As the cleaning means, a cleaning blade 7 is employed. As the developing means, a development roller 6 is used. The more detailed structure of the cartridge P will be described later.

The developing means container of the first cartridge PY stores the toner of yellow (Y) color, and forms a yellow toner image on the peripheral surface of the photosensitive drum 4. The developing means container of the second cartridge PM stores the toner of magenta (M) color, and forms a magenta toner image on the peripheral surface of the photosensitive drum 4. The developing means container of the third cartridge PC stores the toner of cyan (C) color, and forms a cyan toner image on the peripheral surface of the photosensitive drum 4. The developing means container of the fourth cartridge PK stores the toner of black (K) color, and forms a black toner image on the peripheral surface of the photosensitive drum 4.

The apparatus main assembly 1A is provided with a laser scanner unit LB, which is disposed, as an exposing means, in the space above the space in which the cartridges P (PY, PM, PC, and PK) are disposed. The unit LB outputs a beam of laser light L in response to signals which reflect pictorial information. It outputs the beam of laser light in a manner to scan (expose) the peripheral surface of the photosensitive drum 4 through the exposure window 10 of the cartridge P.

The apparatus main assembly 1A is also provided with an intermediary transfer belt unit 11, which is disposed, as a transferring member, in the space below the space in which the cartridges P (PY, PM, PC, and PK) are disposed. This unit 11 has a transfer belt 12, a driver roller 13, a turn roller 14, and a tension roller 15. The transfer belt 12 is an endless belt, and is suspended and stretched by the three rollers 13, 14, and 15. It is circularly driven by the driver roller 13. The photosensitive drum 4 in each cartridge P is in contact with the top surface of the transfer belt 12, by the portion of its peripheral surface, which is facing downward. The area of contact between the photosensitive drum 4 and transfer belt 12 is the primary transfer area. Further, the apparatus main assembly 1A is provided with a primary transfer roller 16, which is disposed on the inward side of the loop which the transfer belt 12 forms. The primary transfer roller 16 is positioned so that it opposes the photosensitive drum 4. There is a secondary transfer roller 17, which is positioned so that it is kept pressed against the driver roller 13, with the presence of the belt 12 between the two rollers 17 and 13. The area of contact between the belt 12 and secondary transfer roller 17 is the second transfer area.

Below the intermediary transfer belt unit 11, a recording medium conveying unit 18 is disposed, which has a tray 19, a feeder roller 20, etc. The tray 19 holds multiple sheets of recording media S in layers.

Further, the apparatus main assembly 1A is provided with a fixation unit 22 and a discharge unit 23, which are in the top rear portion of the apparatus main assembly 1A. A part of the top wall of the apparatus main assembly 1A makes up a delivery tray 24.

While the cartridges P (PY, PM, PC, and PK) are in the cartridge bay 1B, they are kept accurately positioned relative to the cartridge positioning portions (unshown) of the apparatus main assembly 1A by the pressure applied by the pressure applying mechanism (unshown) of the apparatus main assembly 1A. Further, the driving force input portion of each cartridge P is connected with the corresponding driving force output portion of the apparatus main assembly 1A. Moreover, the electrical contacts of each cartridge P are in contact with the electrical contacts of the power supply system (unshown) of the apparatus main assembly 1A.

The operation carried out by the image forming apparatus in this embodiment to form a full-color image is as follows: The photosensitive drum 4 of each of the first to fourth cartridges P (PY, PM, PC, and PK) is rotationally driven at a preset velocity in the counterclockwise direction (indicated by arrow mark). The transfer belt 12 is circularly driven at a velocity which corresponds to the velocity of the photosensitive drum 4, in the clockwise direction (indicated by arrow mark). In other words, the transfer belt 12 is circularly moved in such a direction that the transfer belt 12 and the peripheral surface of the photosensitive drum 4 move in the same direction, in the first transfer area. The laser scanner unit LB is also driven. In synchronism with the driving of the above-mentioned components, the peripheral surface of the photosensitive drum 4 is uniformly charged by the charge roller 5 to preset polarity and potential level. The laser scanner unit LB outputs a beam of laser light L while modulating it with the pictorial signals, which correspond to the monochromatic color images into which the optical image of an original has been separated. It outputs a beam of laser light in a manner to scan (expose) the peripheral surface of the photosensitive drum 4, forming thereby an electrostatic latent image, which reflects the pictorial signals, on the peripheral surface of the photosensitive drum 4. The electrostatic latent image is developed by the development roller 6, which is being rotationally driven at a preset velocity in the clockwise direction (indicated by arrow mark).

Through the electrophotographic image formation process described above, a toner image of yellow (Y) color, which corresponds to the yellow component of an intended full-color image, is formed on the photosensitive drum 4 in the first cartridge PY. This toner image is transferred (primary transfer) onto the transfer belt 12.

Through a process similar to the electrophotographic image formation process used to form a yellow toner image, a toner image of magenta (M) color, which corresponds to the magenta component of the intended full-color image, is formed on the photosensitive drum 4 in the second cartridge PM. This toner image is transferred (primary transfer) onto the transfer belt 12 so that it is layered onto the toner image of yellow (Y) color on the transfer belt 12.

Also through a process similar to the electrophotographic image formation process used to form a yellow toner image, a toner image of cyan (M) color, which corresponds to the cyan component of the intended full-color image, is formed on the photosensitive drum 4 in the third cartridge PC. This toner image is transferred (primary transfer) onto the transfer belt 12 so that it is layered onto the toner image of yellow (Y) color and the toner image of magenta (M) color on the transfer belt 12.

Lastly, through a process similar to the electrophotographic image formation process used to form a yellow toner image, a toner image of black (K) color, which corresponds to the black component of the intended full-color image, is formed on the photosensitive drum 4 in the fourth cartridge PK. This toner image is transferred (primary transfer) onto the transfer belt 12 so that it is layered onto the toner image of yellow (Y) color, toner image of magenta (M) color, and toner image of cyan (C) color on the transfer belt 12.

As a result, an unfixed full-color toner image is formed on the transfer belt 12 by the toner images of Y, M, C, and K colors on the transfer belt 12.

The transfer residual toner, that is, the toner remaining on the peripheral surface of the photosensitive drum 4 of each cartridge P after the primary transfer, is removed by the cleaning blade 7.

Meanwhile, the sheets of the recording media S (which hereafter will be referred to simply as recording media S) are fed, while being separated one by one, into the apparatus main assembly 1A, with a preset control timing. Then, each recording medium S is introduced, with a preset control timing, into the secondary transfer nip, that is, the area of contact between the secondary transfer roller 17 and belt 12, and is conveyed through the nip. While the recording medium S is conveyed through the nip, the layered four toner images, different in color, on the transfer belt 12 are transferred together onto the surface of the recording medium S, as if they are peeled away from the transfer belt 12.

Thereafter, the recording medium S is separated from the surface of the transfer belt 12, and is introduced into the fixation unit 22, through which it is conveyed. While the recording medium S is conveyed through the fixation unit 22, the recording medium S and the toner images thereon are subjected to heat and pressure in the fixation nip of the fixation unit 22. As a result, the toner images are fixed to the recording medium S. Then, the recording medium S is moved out of the fixation unit 22, and is discharged, as a full-color copy, onto the delivery tray 24 by the discharge unit 23.

[Structural Arrangement for Replacing Process Cartridge]

The apparatus main assembly 1A of the image forming apparatus 1 in this embodiment is provided with a cartridge tray 29, which is in the form of a drawer in which the cartridges P (PY, PM, PC, and PK) are held to make it easier for a user to operate the apparatus 1. Thus, the cartridges P in the apparatus main assembly 1A can be easily replaced by pulling the cartridge tray 29 frontward of the apparatus main assembly 1A as far as it is allowed to come out (until it reaches its outermost position). That is, when the cartridge tray 29 is in its outermost position (FIGS. 5 and 6), all the cartridges P (PY, PM, PC, and PK) are out of the apparatus main assembly 1A, making it easier for a user to replace any or all of the cartridges P (PY, PM, PC, and PK) in the cartridge tray 29.

Next, the structural arrangement for making it easier to replace the cartridges P (PY, PM, PC, and PK) in the apparatus main assembly 1A will be described. The front panel of the apparatus main assembly 1A is provided with a hole 26, through which the cartridges P are inserted into, or moved out of, the apparatus main assembly 1A. It is also provided with a door 3 which can be rotationally moved about its hinge 27 so that it can be kept in the closed position in which it keeps the hole 26 closed, or in the open position in which it keeps the hole 26 exposed.

In this embodiment, this door 3 is rotationally opened or closed relative to the apparatus main assembly 1A about the hinge 27 which is at the bottom edge of the door 3. Normally, the door 3 is kept closed. Referring to FIG. 1, as the door 3 is closed, the hole 26 is covered, that is, closed, by the door 3.

Figure 3:
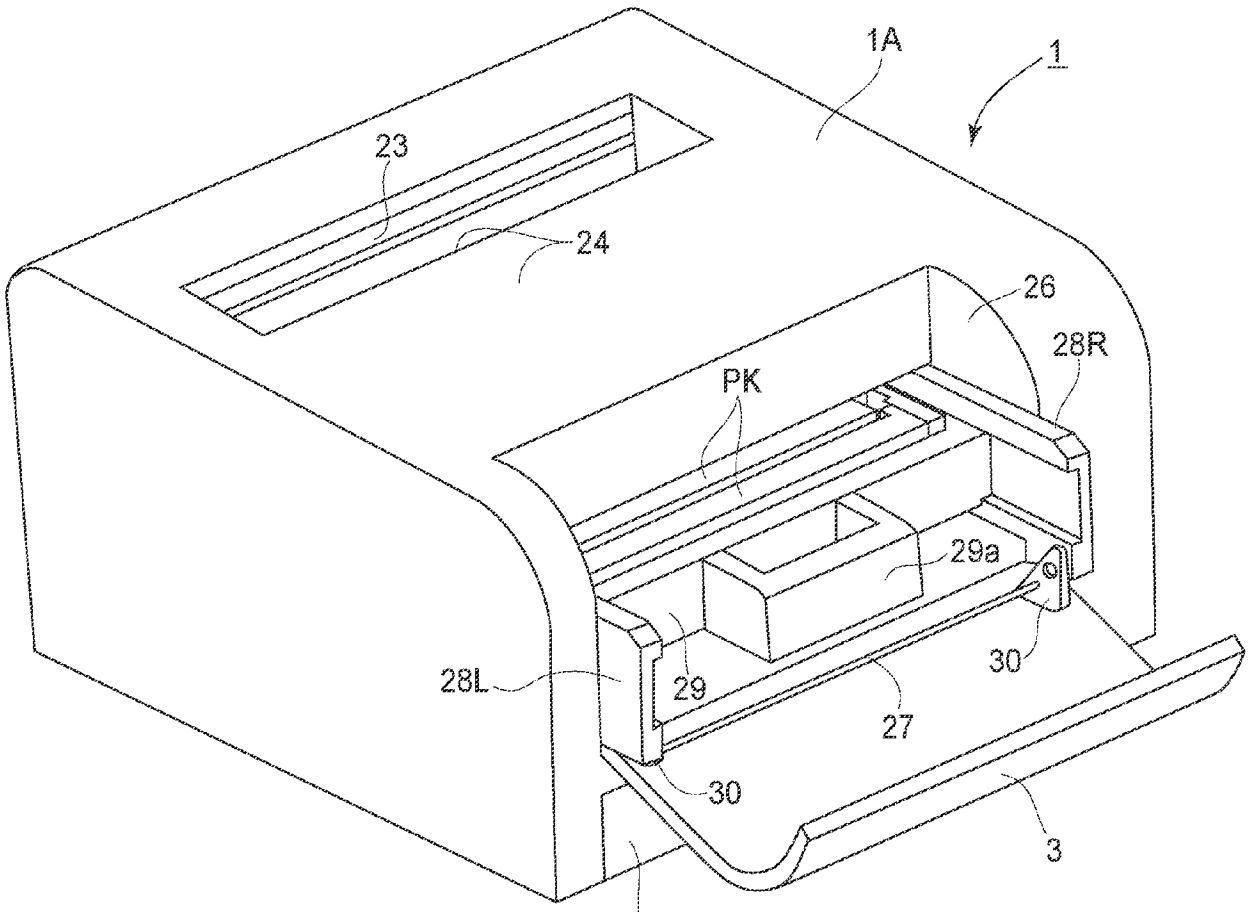
FIG. 3 is a perspective view of the image forming apparatus, the door of which is open.
Figure 4:
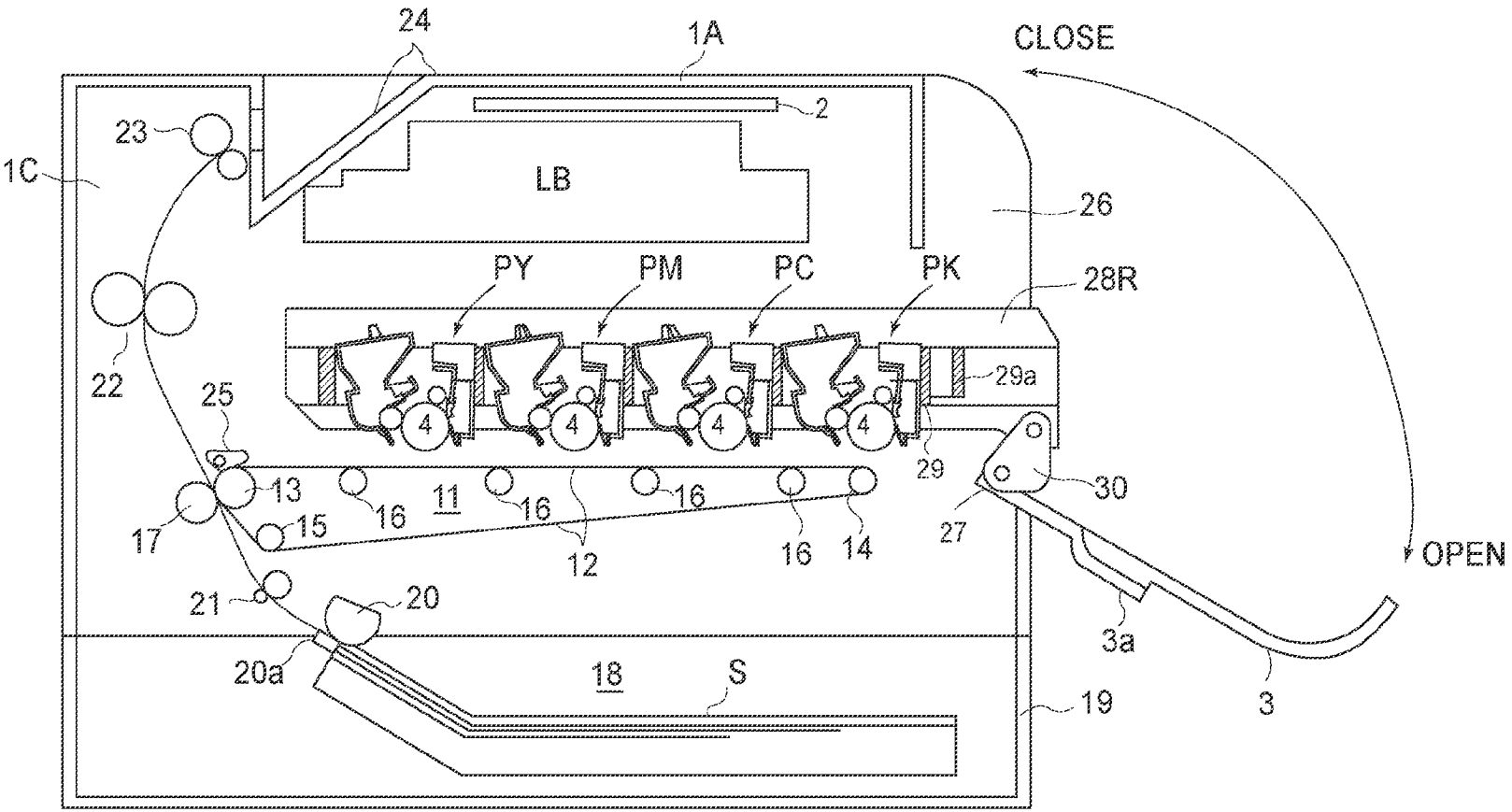
FIG. 4 is a schematic sectional view of the image forming apparatus, the door of which is open, showing the general structure of the apparatus, as seen from the left side of the apparatus.

Referring to FIGS. 3 and 4, the door can be kept open relative to the apparatus main assembly 1A. As the door 3 is opened as shown in FIGS. 3 and 4, the hole 26 is fully exposed, that is, opened. Designated by a reference symbol 3*a* is a door knob.

Next, referring to FIGS. 1, 3, and 4, the apparatus main assembly 1A is provided with a pair of cartridge tray supporting members 28L and 28R, which are attached to the inward side of the left and right sub-frames, respectively, of the main frame 1C of the apparatus main assembly 1A, which oppose each other. The tray supporting members 28L and 28R are structured and positioned to support the cartridge tray 29 between them so that the tray 29 can be roughly horizontally slid in the frontward or rearward of the apparatus main assembly 1A. In other words, the cartridge tray 29 can be moved between its preset innermost position in the apparatus main assembly 1A and its outermost positions from the apparatus main assembly 1A. The cartridge tray 29 is structured so that as the cartridges P (PY, PM, PC, and PK) are mounted in their preset spaces in the tray 29, they become juxtaposed in parallel, in the direction parallel to the moving direction of the tray 29.

The door 3 is indirectly connected to the tray supporting members 28L and 28R through a door link 30. Thus, as the door 3 is opened, the tray holding members 28L and 28R are moved upward by a preset distance along the guiding members (unshown) by the door link 30, and then, are moved frontward by a preset distance; in other words, the tray supporting members 28L and 28R are diagonally moved up- and front-ward from the position in which it is in FIG. 1. In other words, as the door 3 is opened, the tray supporting members 28L and 28R are moved outward so that their front ends protrude a preset distance outward from the apparatus main assembly 1A through the hole 26 of the front panel of the apparatus main assembly 1A.

Further, this movement of the supporting members 28L and 28R causes the driving force input portion of each cartridge P to disengage from the corresponding driving output portion (unshown) of the apparatus main assembly 1A (disengagement of cartridges from apparatus main assembly 1A). Moreover, it removes the pressure which is being applied to the cartridges P by the pressure applying mechanism to keep the cartridges P accurately positioned relative to the cartridge positioning portions of the apparatus main assembly 1A (pressure removal). Thus, the cartridge tray 29 diagonally moves with the supporting members 28L and 28R, in the right and upward direction (FIG. 4), causing thereby each cartridge P in the cartridge tray 29 to move out, while remaining in the tray 29, from where it was kept by the cartridge positioning portion (unshown) of the apparatus main assembly 1A. As a result, the photosensitive drum 4 in each cartridge P becomes separated from the transfer belt 12; the bottommost portion of the peripheral surface of the photosensitive drum 4 in each cartridge P becomes separated from the transfer belt 12, making it possible for the cartridge tray 29 to be pulled out of the apparatus main assembly 1A, to its outermost position. Hereafter, the abovementioned position of the cartridge tray 29, which allows the cartridge tray 29 to be pulled out all the way to its outermost position, may be referred to as the transitional position.

Figure 5:
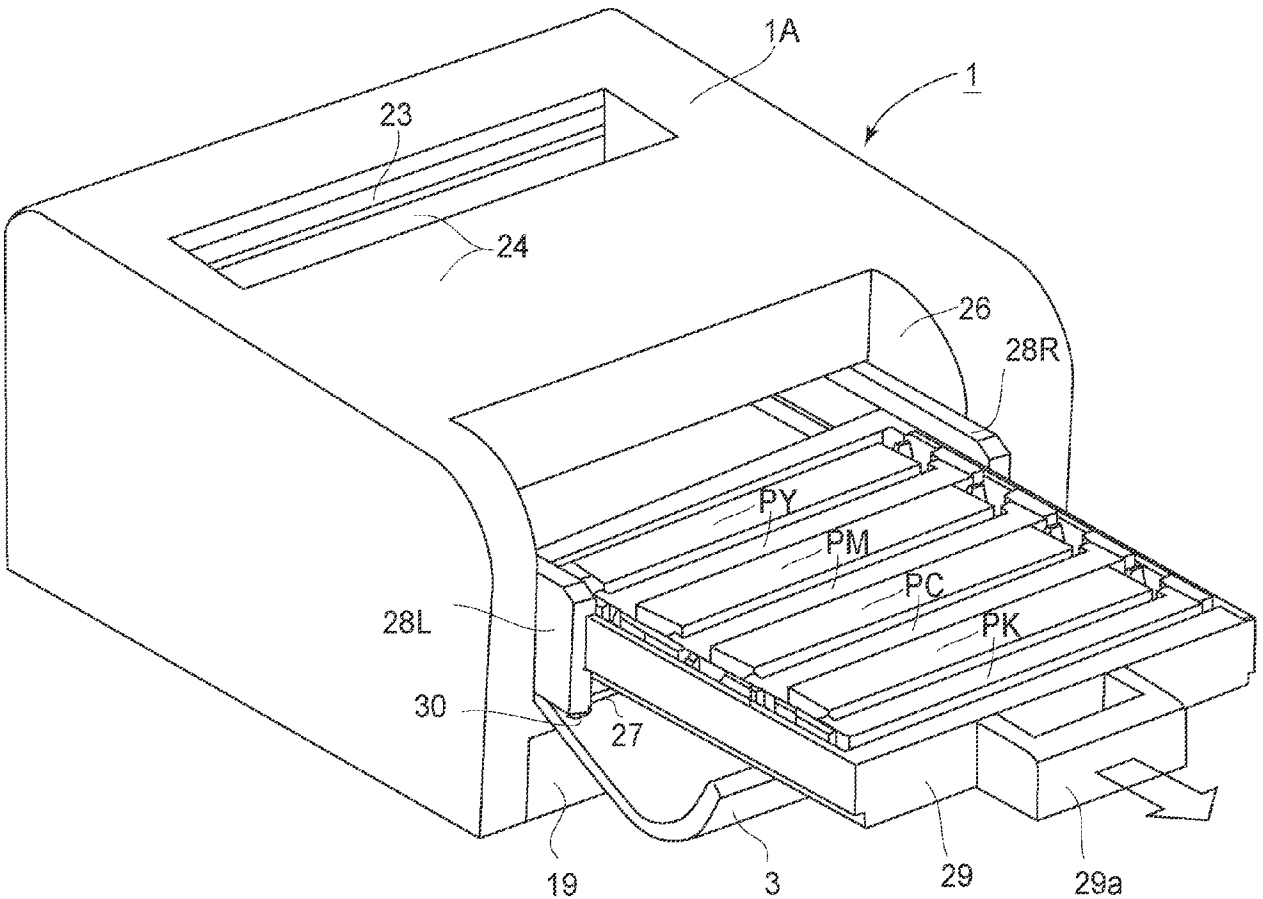
FIG. 5 is a perspective view of the image forming apparatus, the tray of which is in its outermost position.
Figure 6:
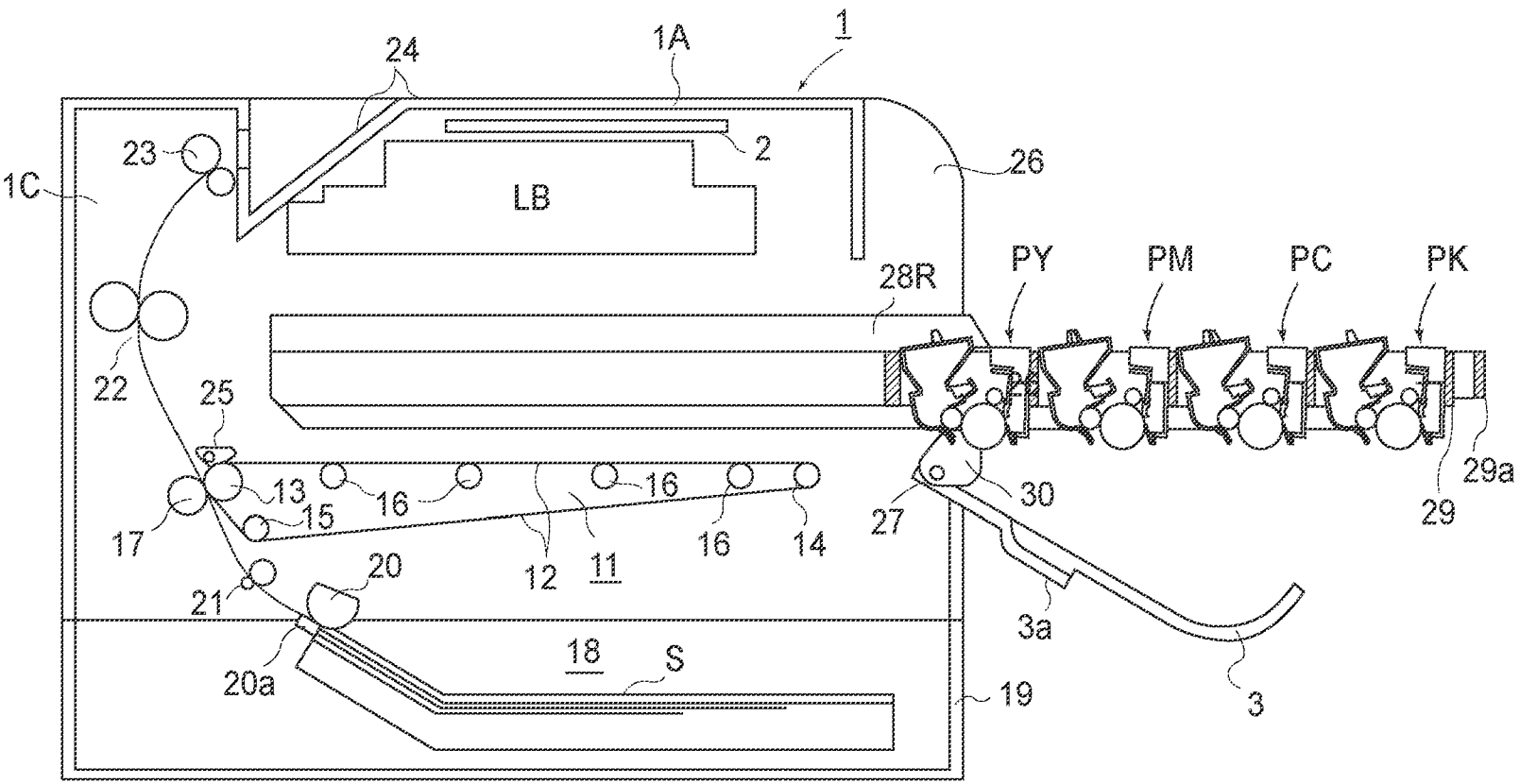
FIG. 6 is a schematic sectional view of the image forming apparatus, the tray of which is in its outermost position, showing the general structure of the apparatus, as seen from the left side of the apparatus.
Figure 7:
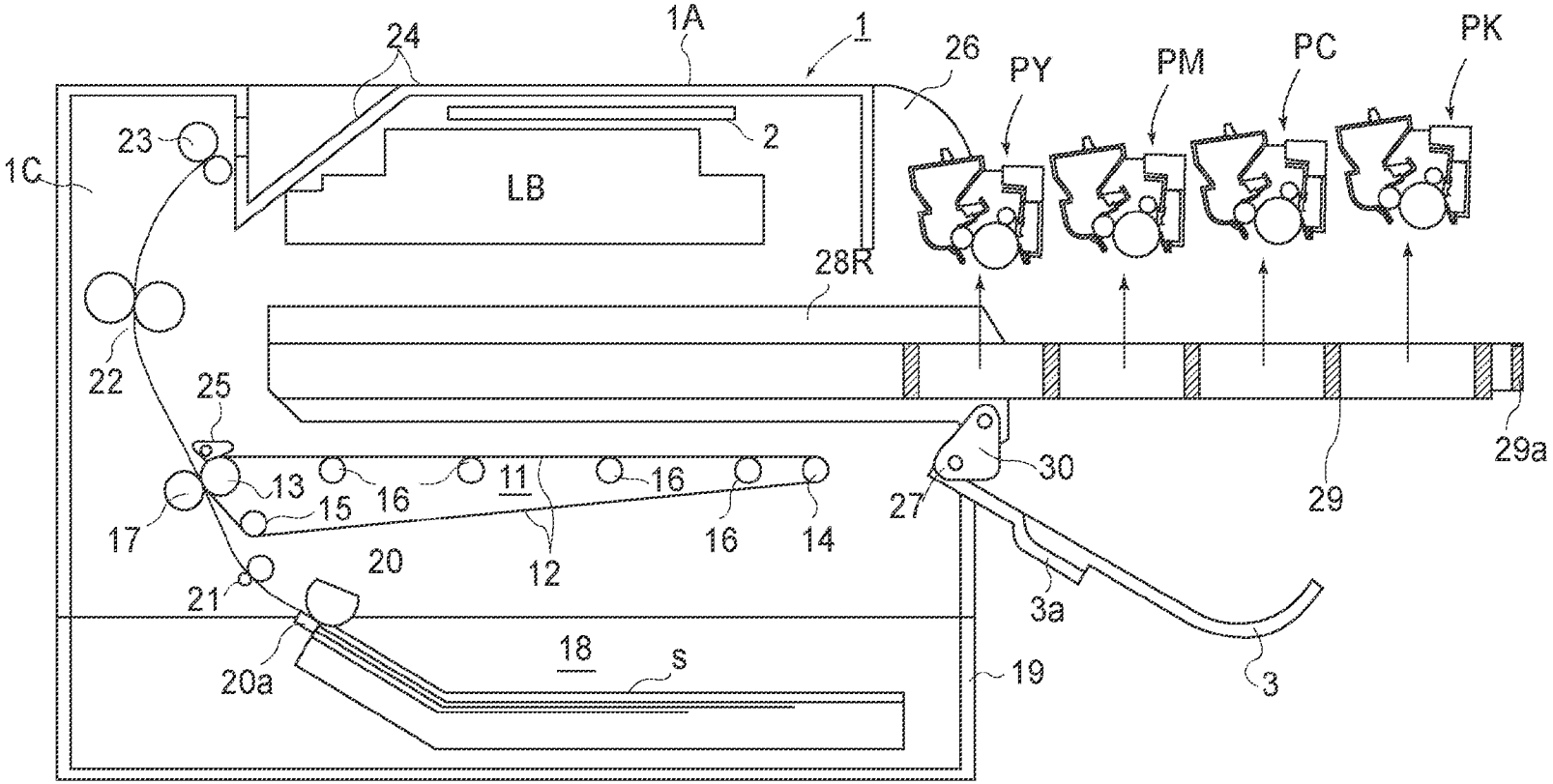
FIG. 7 is a schematic sectional view of the image forming apparatus, the tray of which is in its outermost position, with the cartridges being out of the tray.

Next, a user is to horizontally slide the cartridge tray 29, by grasping the knob 29*a* exposed from the apparatus main assembly 1A through the hole 26, until the cartridge tray 29 reaches its outermost position (preset position, which will be referred to as "outermost position") through the hole 26, as shown in FIGS. 5 and 6.

As the cartridge tray 29 reaches its outermost position, the four cartridges P (PY, PM, PC, and PK), that is, first to fourth cartridges, in the cartridge tray 29 become fully exposed from the apparatus main assembly 1A; it becomes possible to move all cartridges P upward. As the cartridge tray 29 reaches the outermost position, it is stopped by a stopper (unshown), being prevented from being pulled out farther. The apparatus main assembly 1A is structured so that even after the cartridge tray 29 was pulled out to the outermost position, it is kept stable by the supporting members 28L and 28R.

Referring again to FIGS. 5 and 6, while the cartridge tray 29 is moved from the abovementioned transitional position to the outermost position, it continues to support the cartridges P. It is when the cartridge tray 29 is in the outermost position that a user can replace the cartridge(s), which may be empty, in the cartridge tray 29. In order to remove the cartridge(s) from the cartridge tray 29, the cartridge(s) are to be lifted straight upward. A brand-new cartridge is fitted into its designated space in the cartridge tray 29 directly from above. In other words, it is only when the cartridge tray 29 is in the outermost position that a cartridge is vertically inserted into, or pulled out of, (moved into, or out of) the cartridge tray 29.

Before a brand-new cartridge P is used for the first time, it is necessary to remove the sealing member of the cartridge P, which keeps sealed the toner (developer) outlet, through which toner is supplied from the toner storage chamber of the development unit 9 to the development chamber of the development unit 9. This removal of the sealing member will be described later.

After the replacement of the process cartridge(s) in the cartridge tray 29, the user is to carry out in reverse the above described cartridge replacement sequence. That is, first, the user is to horizontally slide rearward the cartridge tray 29, which is in the outermost position, along the supporting members 28L and 28R, until a stopper (unshown) prevents the cartridge tray 29 from being pushed further into the apparatus main assembly 1A, that is, until the cartridge tray 29 is moved into the transitional position shown in FIGS. 3 and 4.

Then, the door 3 is to be closed. As the door 3 is rotationally moved to be closed, the link 30 is moved by the movement of the rotational movement of the door 3. Thus, the supporting members 28L and 28R is pushed a present distance rearward into the apparatus main assembly 1A, following the guiding members (unshown), by the link 30, and then, is moved a preset distance both rearward and downward, by the link 30; the cartridge tray 29 is diagonally moved (downwardly moved while being moved rearward) as shown in FIG. 4. This down- and rearward return movement of the supporting members 28L and 28R causes the process cartridge pressing mechanism to press on each cartridge P, accurately positioning each cartridge relative to the cartridge positioning portions of the apparatus main assembly 1A, that is, placing the cartridge in the position in which it can form an image. The down- and rearward return movement of the supporting member 28L and 28R also causes the driving force input portion of each cartridge P (PY, PM, PC, or PK) to engage with the corresponding driving force output portion of the apparatus main assembly 1A. At the same time, this movement of the supporting members 28L and 28R accurately and immovably positions the cartridge tray 29 relative to the apparatus main assembly 1A, causing thereby the bottommost portion of the peripheral surface of the photosensitive drum 4 in each cartridge P to be is placed in contact with the transfer belt 12. As a result, the state of image forming apparatus 1, which is shown in FIGS. 1 and 2, that is, the state in which the cartridges P (PY, PM, PC, and PK) are in their image forming positions in the apparatus main assembly 1A, is restored. In other words, the image forming apparatus 1 becomes ready for image forming operation.

[General Structure of Process Cartridge]

In terms of the structural arrangement of the process cartridge P for carrying out the electrophotographic process, the first to fourth cartridges P (PY, PM, PC, and PK) in this embodiment are similar to each other, although they are different in the color and amount of the toner they store.

Figure 8:
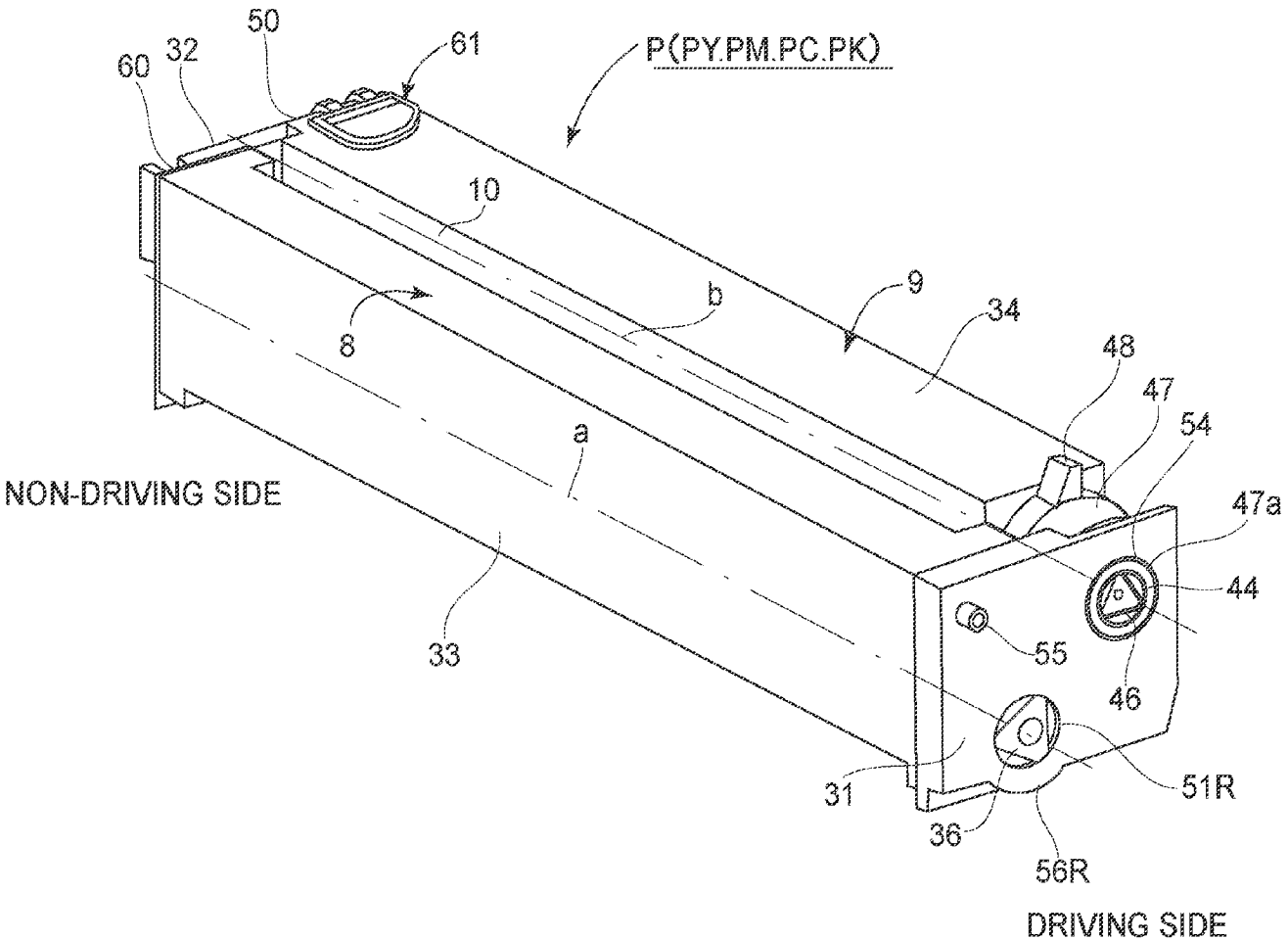
FIG. 8 is a perspective view of a brand-new cartridge, which is out of the box, wrap, and the like, in which the cartridge was shipped, and the sealing member of which has not been removed (prior to unsealing of developer storage chamber).
Figure 9:
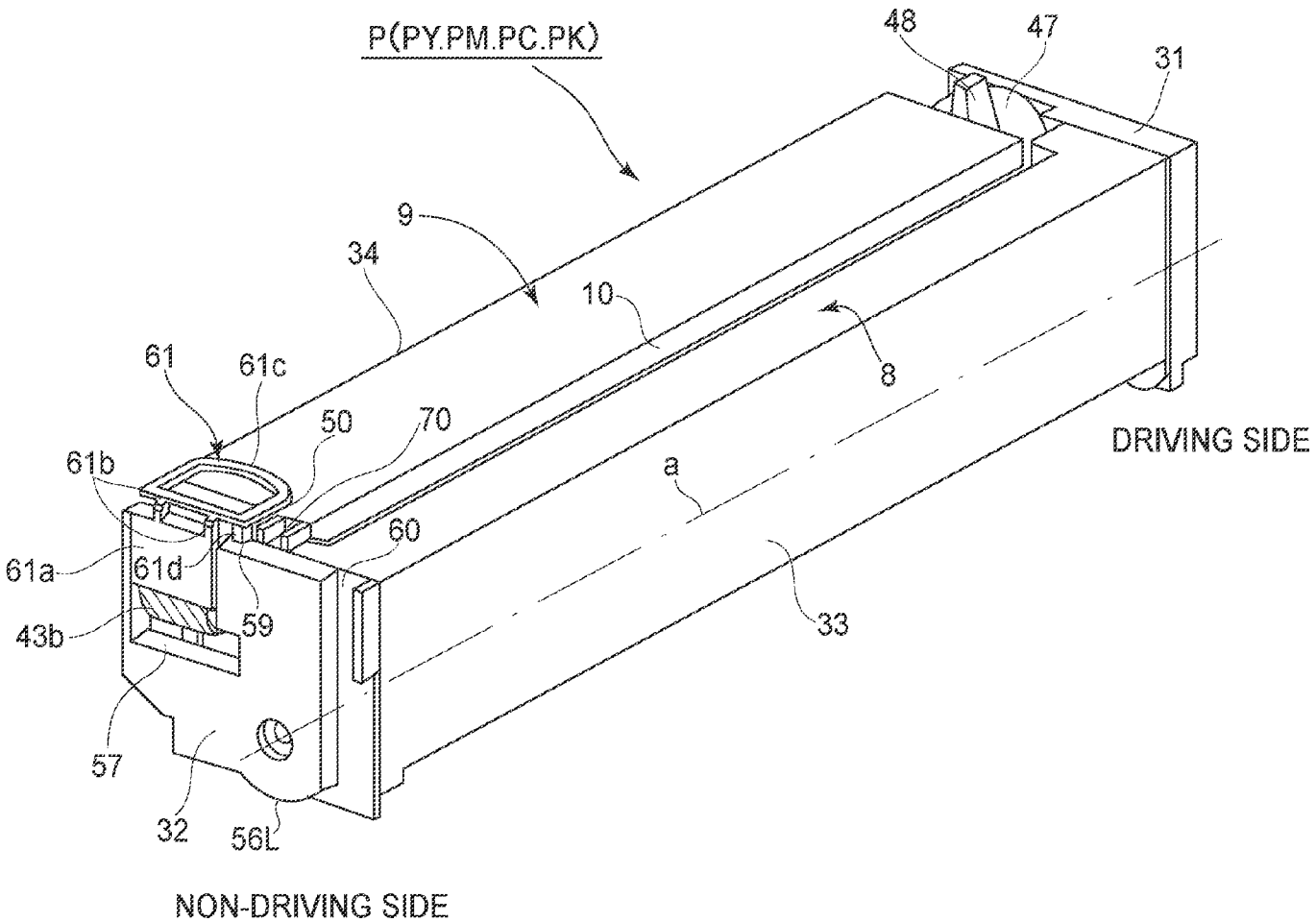
FIG. 9 is a perspective view of the brand-new cartridge P shown in FIG. 8, as seen from the side from which the cartridge is not driven.
Figure 10:
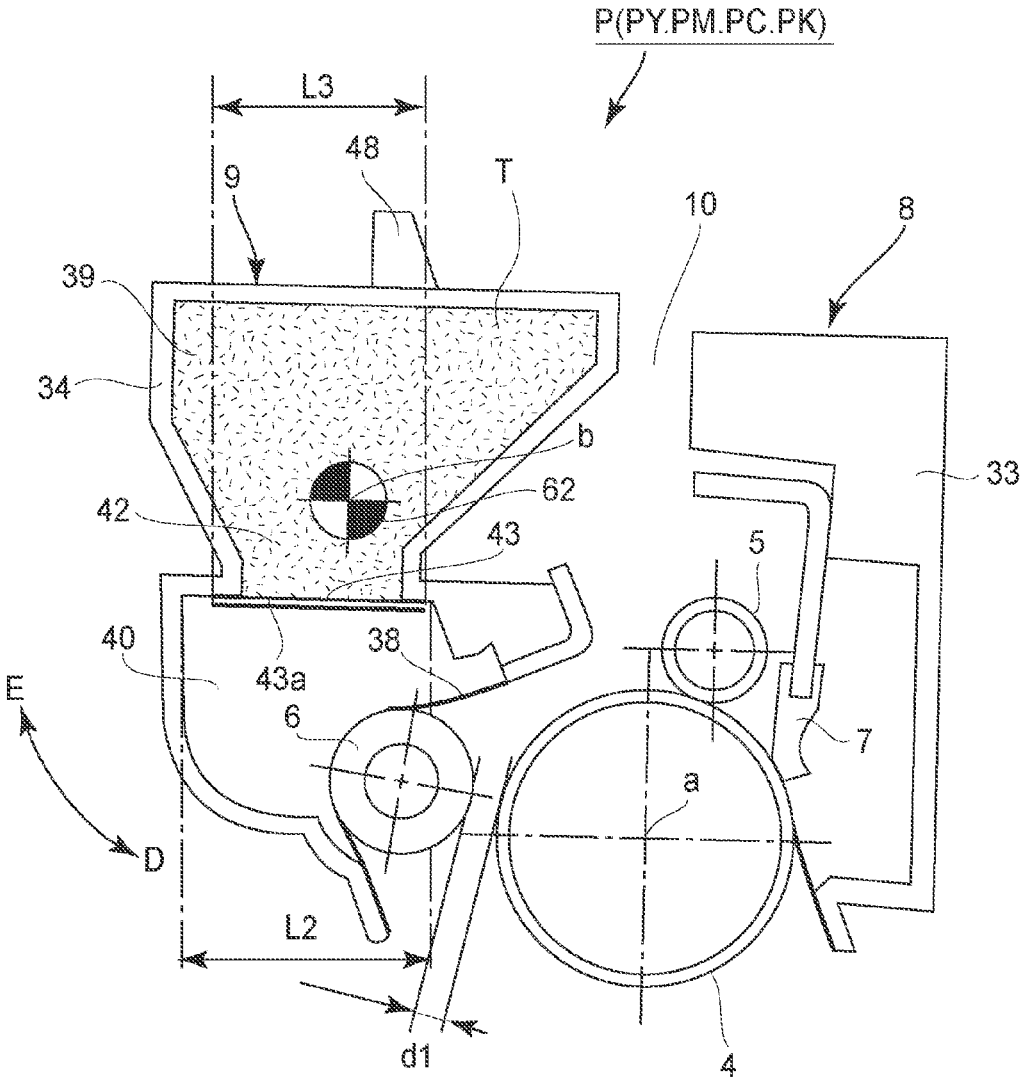
FIG. 10 is a schematic cross-sectional view of the cartridge shown in FIG. 8, as seen from the left side of the cartridge.
Figure 11:
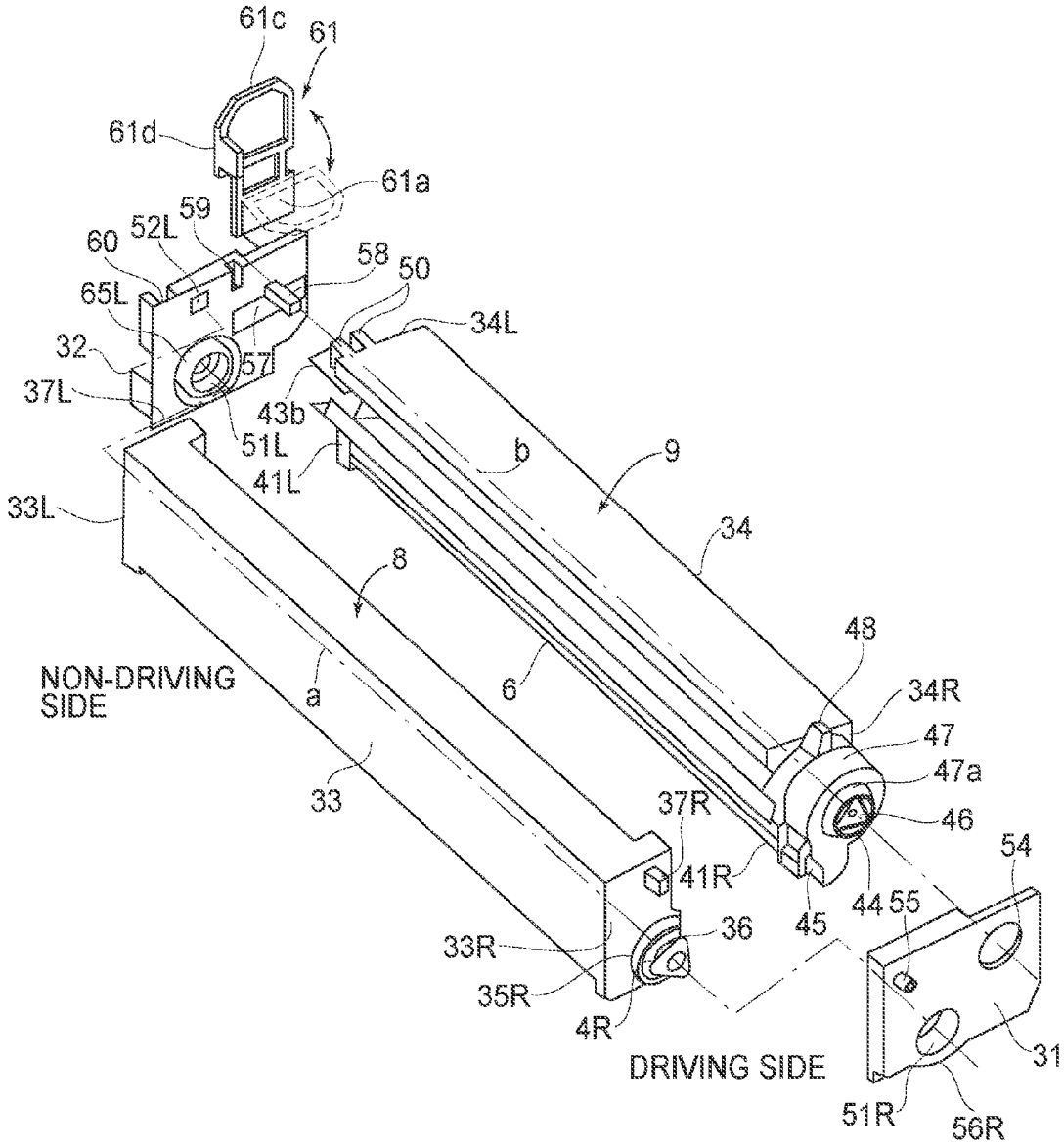
FIG. 11 is an exploded perspective view of the cartridge shown in FIG. 8, as seen from the same side as that from which the cartridge is seen in FIG. 8.
Figure 12:
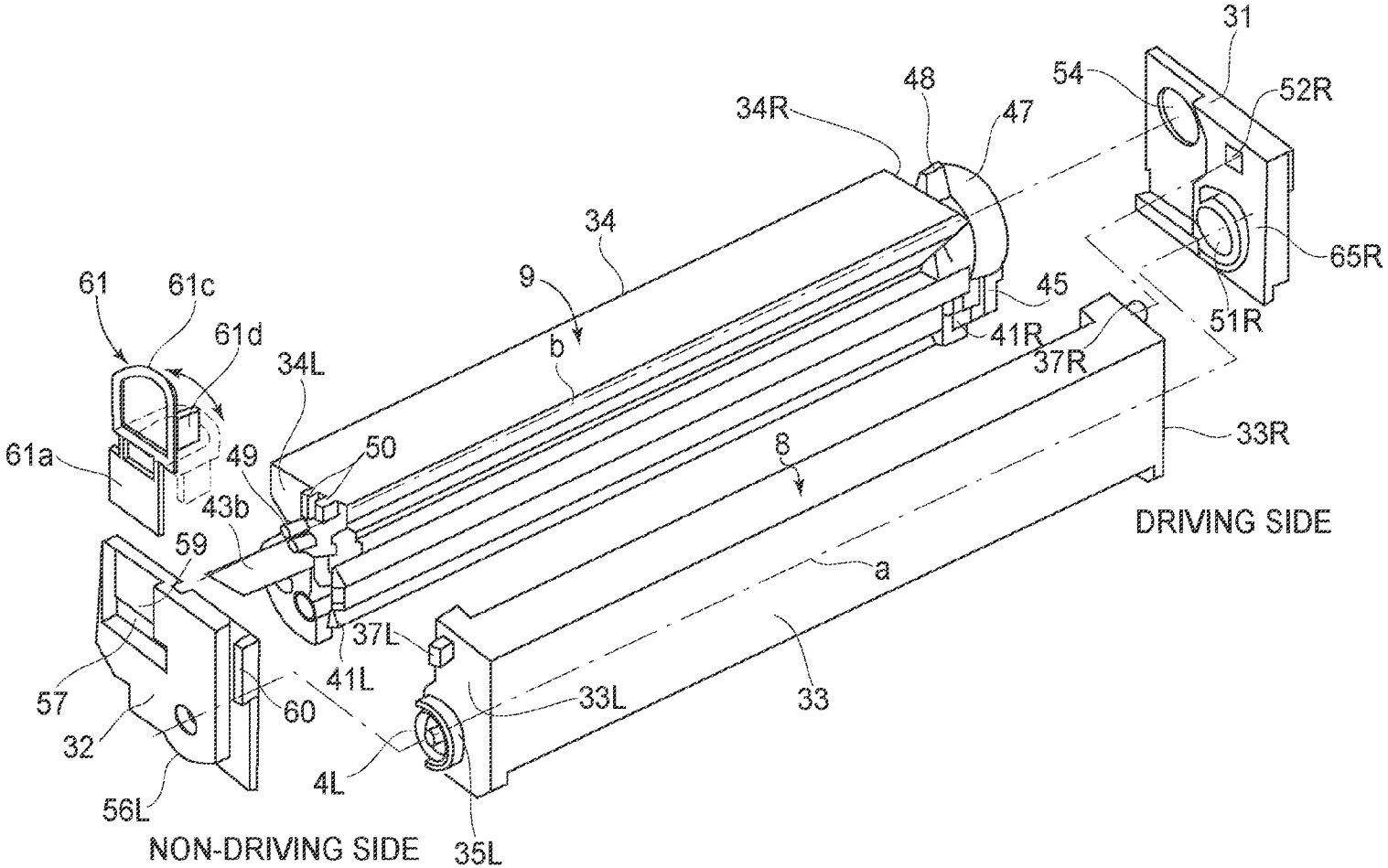
FIG. 12 is an exploded perspective view of the cartridge shown in FIG. 8, as seen from the same side as that from which the cartridge is seen in FIG. 9.

FIG. 8 is a perspective view of a brand-new cartridge, which is out of the box, wrap, and the like, in which the cartridge was shipped, and the removable sealing member of which for keeping the toner outlet of the development unit 9, through which toner is supplied from the toner storage chamber of the development unit 9 to the development chamber of the development unit 9, has not been removed (prior to unsealing of developer storage chamber). FIG. 9 is a perspective view of the brand-new cartridge P shown in FIG. 8, as seen from the side from which the cartridge is not driven. FIG. 10 is a schematic cross-sectional view of the cartridge shown in FIG. 8. FIG. 11 is an exploded perspective view of the cartridge shown in FIG. 8. FIG. 12 is an exploded perspective view of the cartridge shown in FIG. 8, as seen from the same side as that from which the cartridge is seen in FIG. 9.

Referring to FIGS. 8 and 9, each cartridge P (PY, PM, PC, and PK) is an assembly, the lengthwise direction of which is parallel to the direction of the axial line of the photosensitive drum 4. As seen from the front side of the apparatus main assembly 1A, the lengthwise end the cartridge P, which is on the right side, is the lengthwise end (other end) from which the cartridge P is driven, and the lengthwise end of the cartridge P, which is on the left side, is the lengthwise end (one end) from which the cartridge P is not driven. Each cartridge P has the drum unit 8, the development unit 9, the cover 31 (which is on the side from which cartridge is driven), and the cover 32 (which is on the side from which cartridge not driven).

Referring to FIG. 10, the drum unit 8 has a cleaning means container 33 (which is first frame), in which the aforementioned photosensitive drum 4, the charge roller 5, and the cleaning blade 7 are disposed.

The photosensitive drum 4 is rotatably supported by the covers 32 and 31. More specifically, the lengthwise end of the photosensitive drum 4, from which the photosensitive drum 4 is not driven, is rotatably supported by the photosensitive drum supporting portion 51L of the cover 32, shown in FIG. 11, and the other lengthwise end of the photosensitive drum 4, that is, the lengthwise end from which the photosensitive drum 4 is driven, is rotatably supported by the photosensitive drum supporting portion 51R of the cover 31. The photosensitive drum 4 is provided with a drum driving coupling 36 (a driving force transmitting portion), which is attached to the lengthwise end 4R of the photosensitive drum 4 (from which the photosensitive drum 4 is driven) so that the axial line of the drum driving coupling 36 coincides with that of the photosensitive drum 4. It is with this drum driving coupling 36 that the coupling (unshown) of the apparatus main assembly 1A, which is the driving force outputting portion of the apparatus main assembly 1A, engages to transmit the driving force of the driving motor (unshown) which the apparatus main assembly 1A has, to the cartridge P. As the driving force is transmitted to the cartridge P, the photosensitive drum 4 is rotated at a preset velocity in the counterclockwise direction of FIGS. 1, 2, and 22. The charge roller 5 is of the contact type. It is rotated by the rotation of the photosensitive drum 4. More specifically, it is positioned at a preset angle relative to the photosensitive drum 4, and is placed in contact with the photosensitive drum 4. It is rotatably supported by the end walls 33R and 33L of the cleaning means container 33. More specifically, the lengthwise end of the shaft of the charge roller 5, which is on the side from which cartridge P is driven, and the other lengthwise end of the shaft of the charge roller 5, are rotatably supported by a pair of bearings (unshown) attached to the end walls 33R and 33L, one for one.

The blade 7 is made of elastic rubber. It is placed in contact with the peripheral surface of the photosensitive drum 4 in such a manner that its cleaning edge is on the upstream side of its base, in terms of the rotational direction of the photosensitive drum 4. The blade 7 removes the transfer residual toner, that is, the toner remaining on the peripheral surface of the photosensitive drum 4. After the transfer residual toner is removed from the peripheral surface of the photosensitive drum 4 by blade 7, it is stored in the cleaning means container 33.

Referring to FIGS. 11 and 12, the cleaning means container 33 is provided with a pair of projections 37R and 37L, which are on the outward surfaces of the end walls 33R and 33L, which are on the side from which the cartridge P is driven and the side from which cartridge P is not driven, respectively. The pair of projections 37R and 34L are engaged with the covers 31 and 32, respectively.

Referring to FIG. 10, the development unit 9 is made up of the developing means container 34 (second frame), a development roller 6 (developing means), and a development blade 38. Further, the developing means container 34 has the toner storage chamber 39 and the development chamber 40.

Referring to FIGS. 10 and 12, the development roller 6 is in the development chamber 40. It is rotatably supported by the lengthwise end walls 34R and 34L of the developing means container 34, which are on the side from which the cartridge P is driven and the side from which the cartridge P is not driven, respectively. More specifically, the lengthwise end of the axle of the development roller 6, which is on the side from which the cartridge P is driven, and the other lengthwise end of the axle of the development roller 6, are supported by a pair of bearings 41R and 41L attached to the end walls 34R and 34L, respectively.

The development blade 38 is disposed in contact with the peripheral surface of the development roller 6 in such a manner that its functional edge is on the upstream side of its base, in terms of its rotational direction (clockwise direction in FIGS. 2 and 22) of the development roller 6. The development blade 38 plays a role of turning the body of toner on the development roller 6, into a thin uniform layer of toner, which has a preset thickness, on the peripheral surface of the development roller 6.

Figure 13:
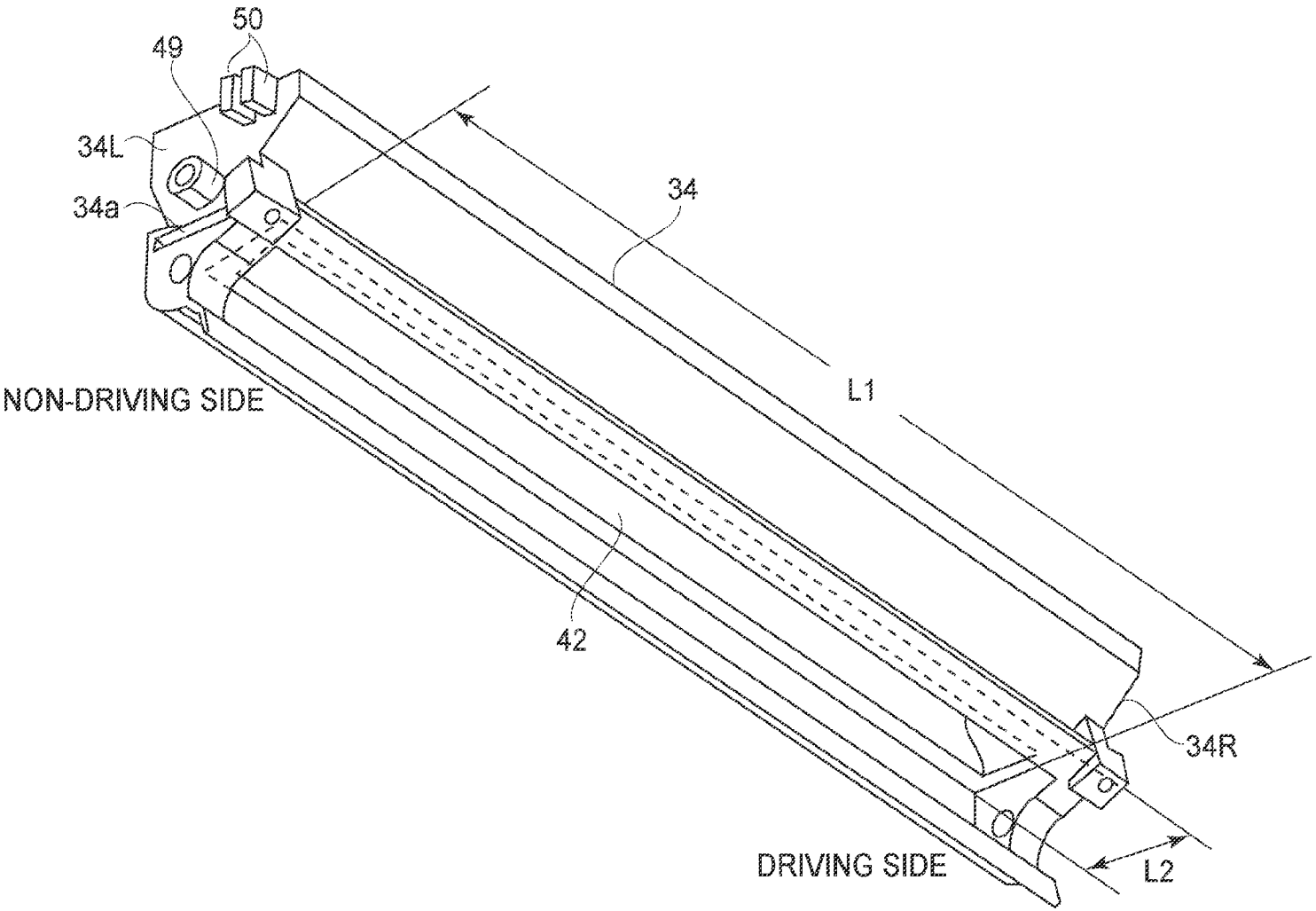
FIG. 13 is a perspective view of the developing means container.
Figure 14:
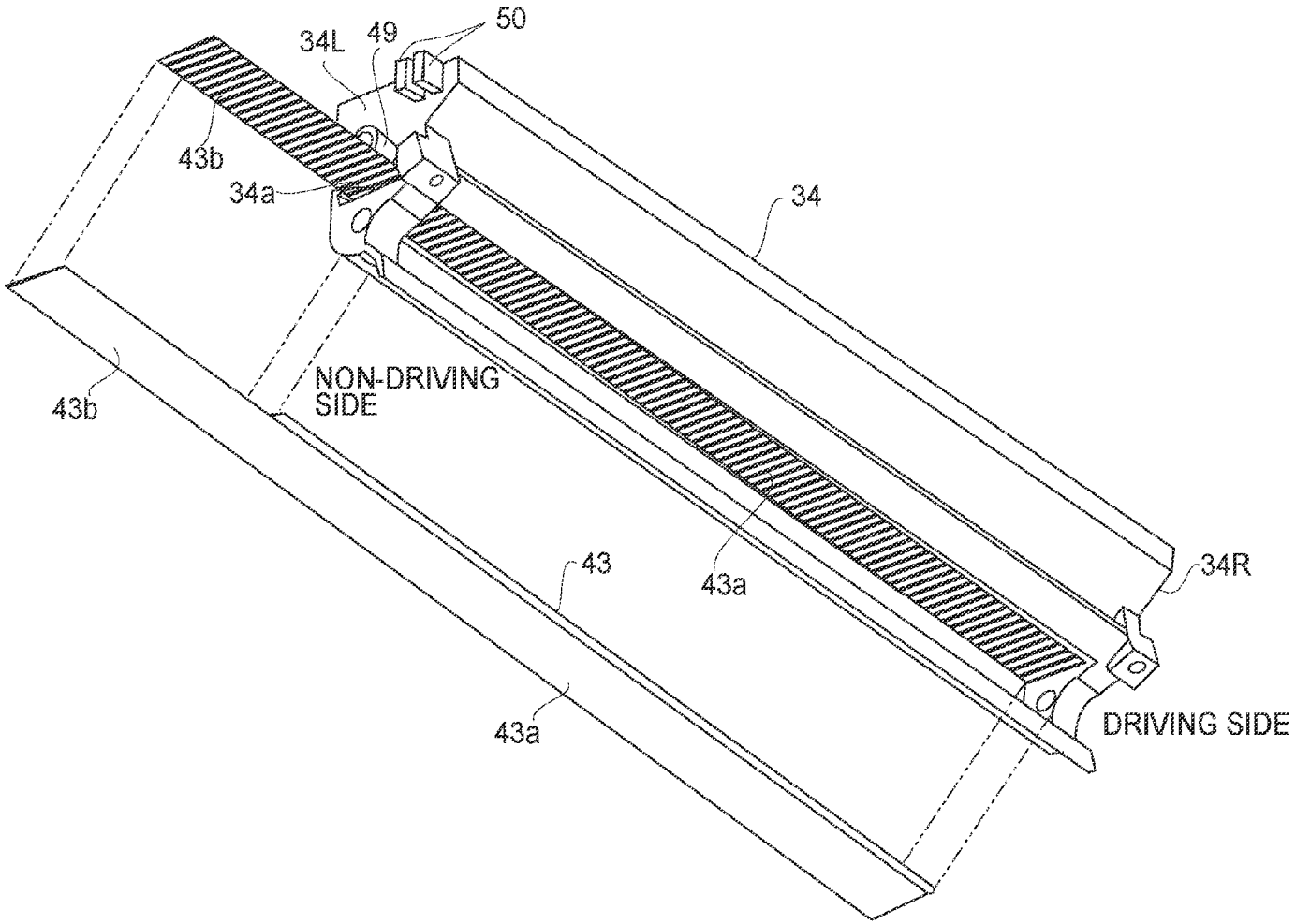
FIG. 14 is a perspective view of the developing means container, the developer outlet of which is remaining sealed with the sealing member.

There is a toner outlet 42 between the toner storage chamber 39 and development chamber 40. The toner outlet 42 has a hole through which toner is supplied from the toner storage chamber 39 to the development chamber while being controlled in the amount by which it is supplied. Referring to FIG. 13, the toner outlet 42 extends from one end of the development roller 6 to the other, in terms of the direction parallel to the rotational axis of the development roller 6 (lengthwise direction of development roller 6). To describe in more detail the dimension and position of the toner outlet 42, in terms of the lengthwise direction of the development roller 6, the length of the toner outlet 42 is less than the length of the development roller 6, and the position of the toner outlet 42 falls within the development range L1, which corresponds to the range of the development roller 6, across which the thin layer of toner is formed on the peripheral surface of the development roller 6 by the development blade 38. In terms of the direction perpendicular to the lengthwise direction of the development roller 6 (direction parallel to shorter edge of toner outlet 42), the dimension of the toner outlet 42 is less than the width L2 of developing means container 34, as shown in FIG. 10. Referring to FIGS. 10 and 14, until a brand-new cartridge P is used for the first time, its toner outlet 42 remains sealed with the sealing member 43 (piece of film) bonded to the edges of the toner outlet 42 by welding or the like method. Thus, until a brand-new cartridge P is used for the first time, the toner storage chamber 39 and the development chamber 40 remain separated from each other by the sealing member 43, and therefore, only the toner storage chamber 39 remains filled with toner T.

That is, for the purpose of preventing toner T from moving from the toner storage chamber 39 into the development chamber 40 before a brand-new cartridge P is used for the first time, the toner outlet 42 is kept sealed by the sealing member 43, which is removable. In this embodiment, the sealing member 43 is formed of a flexible sheet of film, which is 70-200 μm in thickness. It is thermally welded to the edges of the hole of the toner outlet, which are on the developing means container side. Referring to FIG. 14, the sealing member 43 is applied from one lengthwise end (on the side from which cartridge P is not driven) of the toner outlet 42 to the other lengthwise end (on the side from which cartridge P is driven), is folded back at the other lengthwise end, is extended all the way back to the starting point, that is, the lengthwise end of the toner outlet 43 on the side from which cartridge P is not driven, and is extended outward from the developing means container through a sealing member removal slot 34*a*. Designated by a reference 1 symbol 43*a* is the overlapping (doubled-back) portion of the sealing member 43, that is, the portion of the sealing member 43, which is extended from the lengthwise end of the toner outlet, which is on the side from which the cartridge P is driven, to the lengthwise end of the toner outlet, which is on the side from which the cartridge is not driven. Designated by a reference 1 symbol 34*b* is the portion of the sealing member 43, which is extending outward from the developing mean container 34 through the sealing member removal slot 34*a*. The sealing member removal slot 34*a* is the slot with which the end wall of the developing means container 34, which is on the side from which the cartridge P is not driven, is provided to allow the sealing member 43 to be pulled out of the developing means container 34 to unseal the toner outlet 42.

Referring to FIG. 11, there is a driving force input gear 44, the position of which roughly coincides with the center of the outward surface of the end wall 34R of the developing means container 34, which is on the side from which the cartridge P is driven. The driving force input gear 44 is supported by the cylindrical portion 47*a* of a side cover 47 attached to the end wall 34R of the developing means container 34. More specifically, the driving force input gear 44 is supported by the cylindrical portion 47*a* so that its rotational axis coincides with the axial line of the cylindrical portion 47*a*. The driving force input gear 44 is in engagement with a gear 45, which is for transmitting the rotational force from the driving force input gear 44 to the development roller 6 to drive the development roller 6. A side cover 47 is the cover for the driving force input gear 44 and gear 45. Further, the driving force input gear 44 is provided with a developing means driving coupling 46 (driving force transmitting member), through which the force for driving the developing means is inputted. The coupling 46 is attached to the outward surface of the driving force input gear 44. It is to this coupling 46 that the coupling (unshown) of the apparatus main assembly 1A, which is the developing means driving force outputting portion, is engaged to transmit the developing means driving force to the developing means. As the developing means driving force is transmitted, the development roller 6 is rotationally driven in the clockwise direction of FIGS. 2 and 22. Further, the bearing 41R is provided with a separation rib 48, which protrudes upward from the peripheral surface of the bearing 41R. The separation rib 48 is the portion of the bearing 41R, which catches the force from the apparatus main assembly 1A. As the separation rib 48 catches the force from the apparatus main assembly 1A, the development unit 9 is moved from the position in which its development roller 6 is in contact with the photosensitive drum 4, to the position in which its development roller 6 is not in contact with the photosensitive drum 4.

Referring to FIG. 12, the end wall 34L of the developing means container 34, that is, the end wall of the developing means container 34, which is on the side from which the cartridge P is not driven, is provided with a cylindrical boss 49, which is roughly in the center of the outward surface of the end wall 34L. The axial line of the boss 49 coincides with the rotational axis b of the driving force input gear 44. The rotational axis b of the driving force input gear 44 is parallel to the rotational axis of the photosensitive drum 4. Further, the end wall 34L is provided with a pair of projections 50, which are on the upwardly facing surface of the end wall 34L. The projections 50 are aligned in the direction perpendicular to the lengthwise direction of the cartridge P, with the presence of a preset interval.

The cover 31, that is, the cover on the side from which the cartridge P is driven, is provided with a groove 65R and a recess 52R. The groove 65R is the groove in which the circular rib 35R, which is on the side from which the cartridge P is driven, fits. The circular rib 35R is the circular rib which engages with the lengthwise end of the shaft of the drum 4, which is on the side from which the cartridge is driven. The recess 52R is the recess in which the projection 37R fits. The cover 31 is also provided with a cylindrical hole 54 into which the cylindrical portion 47*a* of the side cover 47 of the development unit 9 fits. Further, the outward surface of the cover 31 is provided with a boss 55 for controlling the cartridge P in attitude, in the apparatus main assembly 1A. The cover 31 is also provided with a positioning bulge 56R (as seen in FIG. 11), which bulges from the bottom edge of the cover 31. The positional bulge 56R functions as the means for accurately positioning the lengthwise end of the cartridge P, which is on the side from which the cartridge P is driven, relative to the cartridge positioning portion (unshown) of the apparatus main assembly 1A.

Referring to FIG. 11, the cover 32, that is, the cover on the side from which the cartridge P is not driven, is provided with a groove 65L and a recess 52L, in which the circular rib 35L and projection 37L of the drum unit 8, which are on the side from which the cartridge P is not driven, fit, respectively. Further, the cover 32 is provided with a slot 57 through which the sealing member 43 is pulled out. The cover 32 is also provided with a shaft 58 and a recess 59, which are on the inward side of the cover 32. The shaft 58 fits in the cylindrical hole of the cylindrical boss 49 of the development unit 9, which is on the side from which the cartridge is not driven. The recess 59 corresponds in position to the gap between the aforementioned pair of projection 50 of the development unit 9, which are on the side from which the cartridge P is not driven. Further, the cover 32 is provided with a groove 60, which is located on the outward side of the cover 32 to prevent the cartridge P from excessively tilt in the apparatus main assembly 1A. Further, the cover 32 is provided with a bulge 56L (as seen in FIG. 12), which bulges downward from the bottom edge of the cover 32. The bulge 56L is for accurately positioning the cartridge P relative to the cartridge positioning portion (unshown) of the apparatus main assembly 1A.

On the side from which the cartridge P is driven, the lengthwise end of the drum unit 8 and the lengthwise end of the development unit 9 are covered with the cover 31, whereas on the side from which the cartridge P is not driven, the lengthwise end of the drum unit 8 and the lengthwise end of the development unit 9 are covered with the cover 32. On the side from which the cartridge P is driven, the circular rib 35R, the projection 37R of the drum unit 8, and the cylindrical portion 47*a* of the side cover 47 of the development unit 9, fit in the groove 65R, recess 52R, and cylindrical hole 54 of the cover 31, respectively. The cover 31 is fixed to the drum unit 8 with the use of screws or the like. On the side from which the cartridge P is not driven, the cylindrical rib 35L (which engages with the lengthwise end of the shaft of the drum 4) and the projection 37L of the drum unit 8, of the development unit 9, fit in the drum shaft engagement groove 65L and recess 52L of the cover 32, respectively, and the cylindrical boss 49 of the development unit 9 accommodates the shaft 58. Further, the portion 43*b* of the sealing member 43, which is extending from the development unit 9 through the sealing member removal slot 34*a*, is put through the sealing member removal slot 57 of the cover 32. The cover 32 is fixed to the drum unit 8 with the use of screws or the like.

Figure 15:
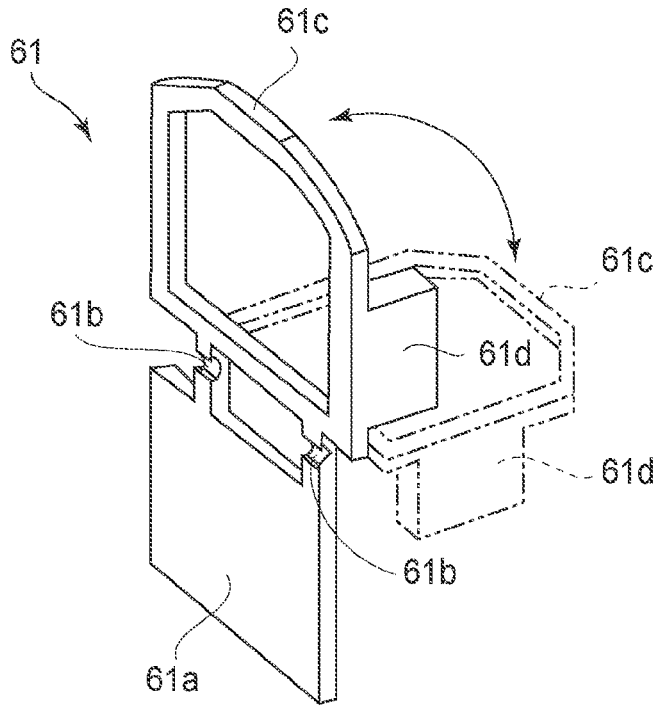
FIG. 15 is a perspective view of the pull-tab.

Further, for the purpose of making it easier for a user to grasp the sealing member 43, a pull-tab 61 is attached (by welding or the like method) to the end of the portion 43*b* of the sealing member 43, which is extending through the slot 57 of the cover 32. FIG. 15 is an enlarged perspective view of the pull-tab 61. The pull-tab 61 is formed of an elastic substance, such as polypropylene (PP). It has a portion 61*a*, a portion 61*b*, and a portion 61*c*. The portion 61*a* is the base portion (anchoring portion) by which the pull-tab is attached to the end portion of the portion of the sealing member 43, which is extending from the cartridge P. The portion 61*b* is between the portions 61*a* and 61*c* and functions like a hinge. The portion

61*c* is the actual tab portion. Thus, the pull-tab 61 can be bent at the hinge portion 61*b* so that the actual tab portion 61*c* can be locked with the pull-tab locking portion (unshown) of the cartridge P.

Referring to FIG. 8, the development unit 9 is supported between the covers 31 and 32, by the covers 31 and 32, in such a manner that it can be rotationally moved about the axial line b of the rotational movement of the development unit 9, which is parallel to the axial line a of the photosensitive drum 4. That is, the development unit 9 is connected to the drum unit 8 in such a manner that they are allowed to rotationally move relative to each other. On the side from which the cartridge P is driven, the cylindrical portion 47*a* of the side cover 47 is fitted in the cylindrical hole 54 of the cover 31, whereas on the side from which the cartridge P is not driven, the cylindrical boss 49 is fitted around the shaft 58 of the cover 32. Therefore, the development unit 9 can be rotationally moved in such a manner that its rotational axis coincides with the axes of the cylindrical portion 47*a*, cylindrical hole 54, boss 49, and shaft 59. The rotational axis of the development unit 9 practically coincides with the rotational axis b of the developing means driving force transmission coupling 46. Referring to FIG. 10, designated by a reference symbol 62 is the abovementioned rotational axis. The employment of the above described structural arrangement makes it possible to allow the development unit 9 and drum unit 8 to rotationally move relative to each other while the force for driving them is transmitted to them from the apparatus main assembly 1A. The gap between the drum unit 8 and development unit 9, which is designated by a reference 1 numeral 10, functions as the exposure window 10.

The cartridge P is structured so that in terms of the direction perpendicular to the plane of the opening of the toner outlet 42 which is remaining sealed with the sealing member 43 (that is, direction perpendicular to sealing member 43), the aforementioned axis 62 of the rotational oscillatory movement of the development unit 9 falls within the range L3, which corresponds to the width of the sealing member 43.

Further, the cartridge P is provided with a pair of compression springs 70 (FIG. 9), which are the pressure applying means for keeping the development unit 9 always pressed in the direction D (FIGS. 10, 18, 20, and 22), that is, the direction in which the development unit 9 is to be rotationally moved about the axis 62 to place the development roller 6 in contact with the drum 4.

When the cartridge P is shipped without being mounted in the apparatus main assembly 1A of the image forming apparatus 1, the development unit 9 is kept in the position into which it is rotationally moved by being moved in the direction E (FIG. 10), which is opposite from the direction D, against the resiliency of the compression springs 70 (FIG. 9), about the axis 62, so that the development roller 6 is moved away from the drum 4 to provide a preset distance d1 (gap) between the development roller 6 and photosensitive drum 4. Thus, while the cartridge P is shipped without being mounted in the apparatus main assembly 1A, the distance d1 (gap) is maintained between the development roller 6 and the photosensitive drum 4. This distance d1 (gap) is provided to prevent the development roller 6 from coming into contact with the photosensitive drum 4 due to the vibrations and shocks which occur during the shipment of the cartridge P.

Figure 16:
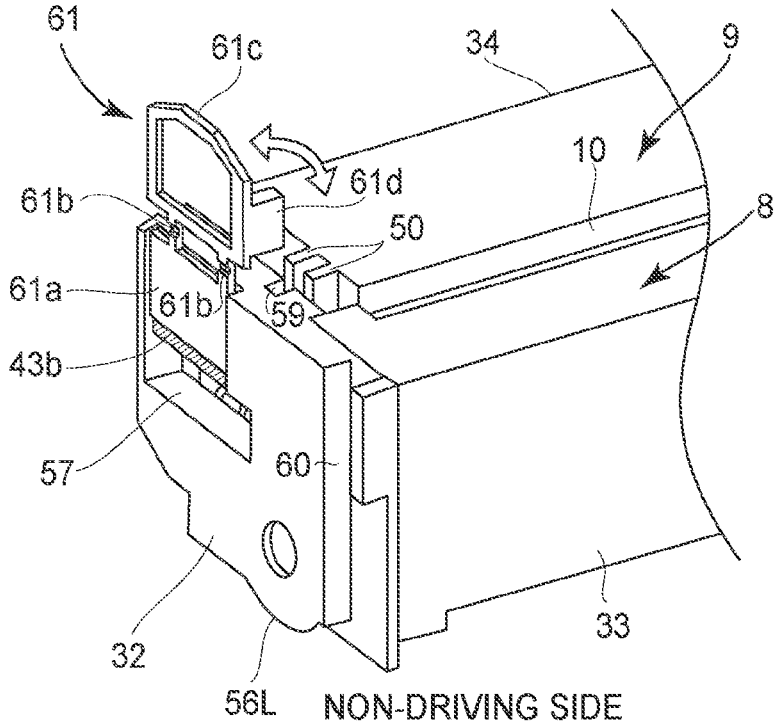
FIG. 16 is a perspective view of the pull-tab, the actual tab portion of which is in the upright position, and the adjacencies of the pull-tab.
Figure 17:
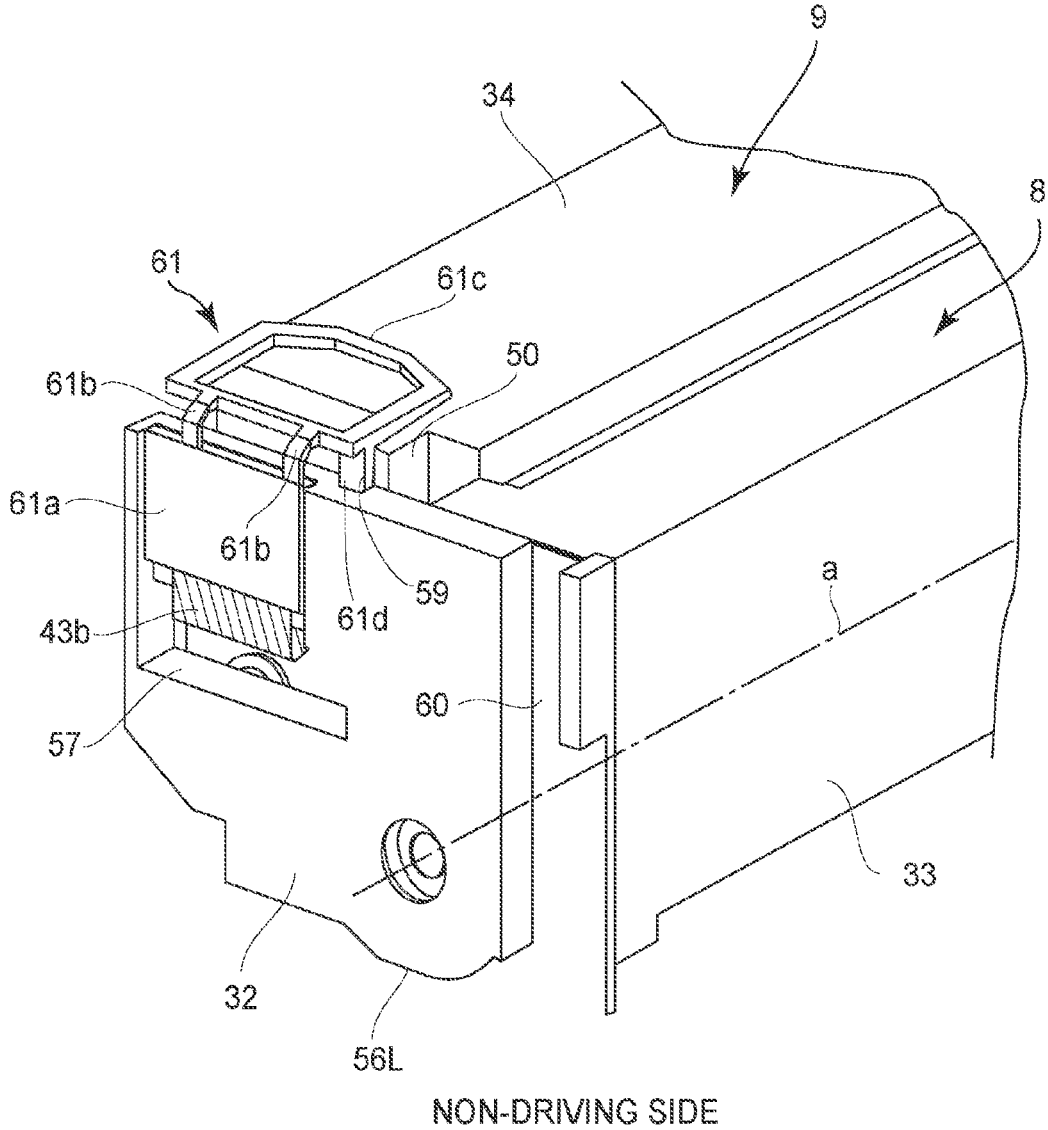
FIG. 17 is a perspective view of the pull-tab, which has been bent at its hinge portion to make its actual tab portion lie flat on the top surface of the development unit, and the adjacencies of the pull-tab.

In this embodiment, the pull-tab 61 is utilized to keep the development roller 6 separated from the photosensitive drum 4 during the shipment of the cartridge P. That is, in this embodiment, the actual tab portion 61*c* of the pull-tab 61 is provided with a projection 61*d* (for keeping the development roller 6 separated from the photosensitive drum 4), which protrudes from one of the lateral edges of the actual tab portion 61*c*. The projection 61*d* is locked with the pull-tub locking portion of the cartridge P in the following manner. That is, first, the development unit 9 is rotationally moved about the axis 62 of the rotational movement of the development unit 9, against the resiliency of the compression springs, in the direction E, which is opposite from the direction D, so that the gap between the pair of projections 50 which are on the side from which the cartridge is not driven, aligns with the recess 59 of the cover 32, that is, the cover on the side from which the cartridge P is not driven, as shown in FIG. 16. Then, the pull-tab 61, which is in the state shown in FIG. 16, is roughly perpendicularly bent toward the top surface of the cartridge P at the hinge portion 61*b* so that the actual tab portion 61*c* becomes roughly perpendicular to the base portion 61*a* (anchoring portion). As a result, the pull-tab locking projection 61*d* of the actual tab portion 61*c* fits into both the gap between the pair of projections 50 and the recess 59, as shown in FIG. 17. The fitting of the pull-tab locking projection 61*d* into the abovementioned gap and recess prevents the development unit 9 from rotating relative to the cover 32, keeping thereby the development roller 6 separated from the photosensitive drum 4 with the presence of the distance d1 (gap) between the development roller 6 and photosensitive drum 4. In other words, it keeps the cartridge P in the state shown in FIG. 10.

[Operation for Removing Sealing Member 43]

Next, the operation to be carried out for removing the sealing member 43 (operation for unsealing toner storage chamber) when a brand-new cartridge P is put to use for the first time will be described. This is the operation for removing the sealing member 43, which keeps blocked the toner outlet 42 through which the toner T is supplied from the toner storage chamber 39 of the development unit 9 to the development chamber 40 of the development unit 9.

First, a user is to take a brand-new cartridge P out of the box, wrap, or the like, in which the cartridge was shipped. Referring to FIG. 10, the toner outlet 42 of the brand-new cartridge P, through which the toner T is supplied from the developer storage chamber 39 of the development unit 9 to the development chamber 40 of the development unit 9, is kept sealed with the sealing member 43 until the cartridge P is used for the first time. Further, the development unit 9 is kept immovable relative the drum unit 8 by the development unit locking projection 61*d* of the pull-tab 61 to keep the development roller 6 separated from the photosensitive drum 4 by the preset distance d1.

First, the user is to hook, with his finger, the actual tab portion 61*c* of the pull-tab, which is remaining laid flat on the top surface of the development unit 9 (pull-tab 61 has been roughly perpendicularly bent at hinge portion 61*b* to lay actual tab portion 61*c* flat on top surface of development unit 9), as shown FIG. 17. Then, the user is to pull the actual tab portion 61*c* upward to erect it as shown in FIG. 16. As the actual tab portion 61*c* is pulled upward, the development unit locking projection 61*d* of the actual tab portion 61*c* comes out of the gap between the pair of projections 50, and the recess 59 of the cover 32, freeing thereby the development unit 9 in terms of rotational movement. As a result, the development unit 9 is rotationally moved by the resiliency of the compression springs 70 (FIG. 9) in the counterclockwise direction D in FIGS. 10 and 18, about the axis 62 of the rotational movement of the development unit 9, ensuring thereby that the development roller 6 comes into, and remains in, contact with the photosensitive drum 4 as shown in FIG. 18.

Figure 19:
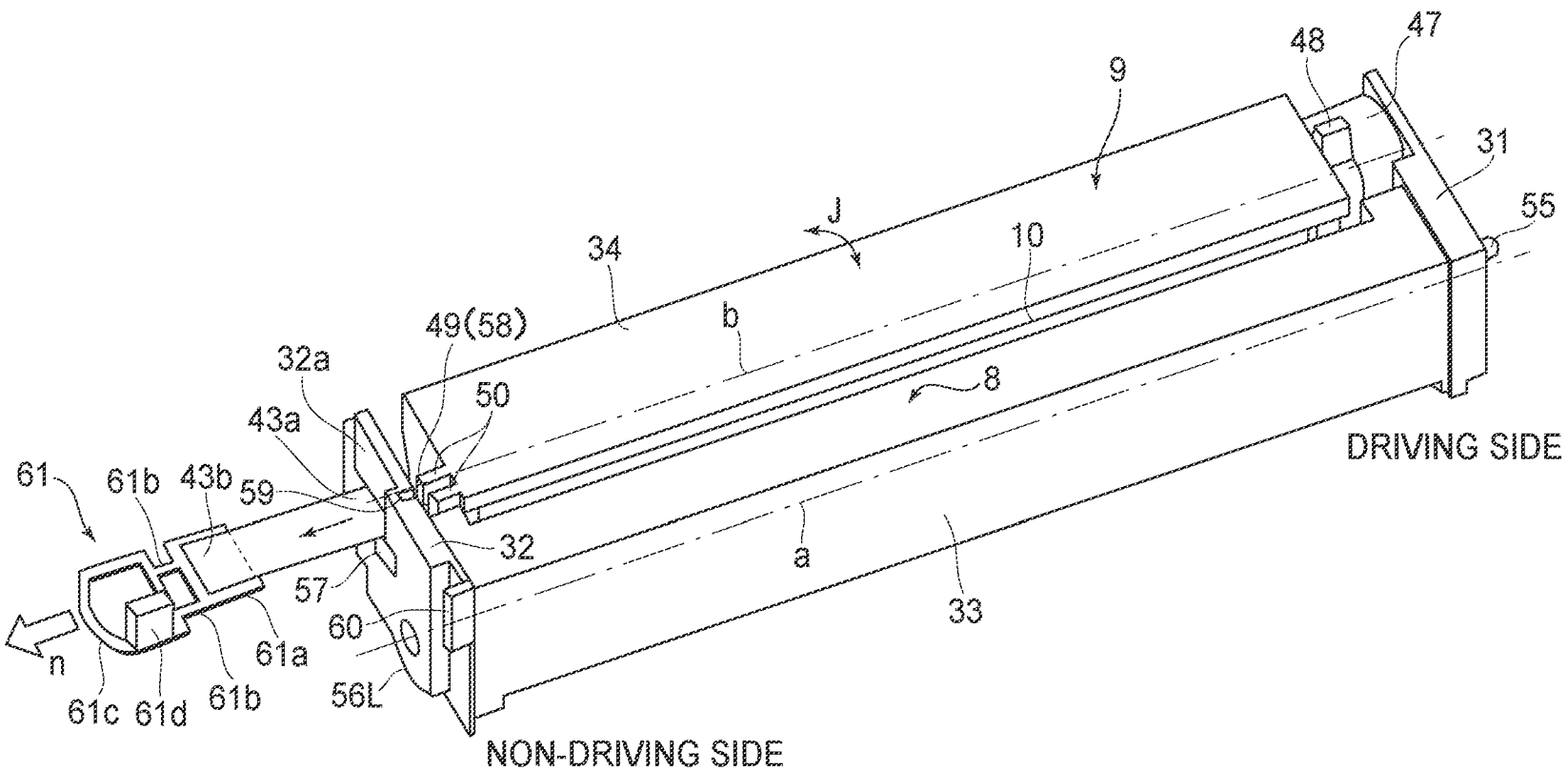
FIG. 19 is a perspective view of the process cartridge, which shows how the sealing member is to be removed (pulled out).
Figure 21:
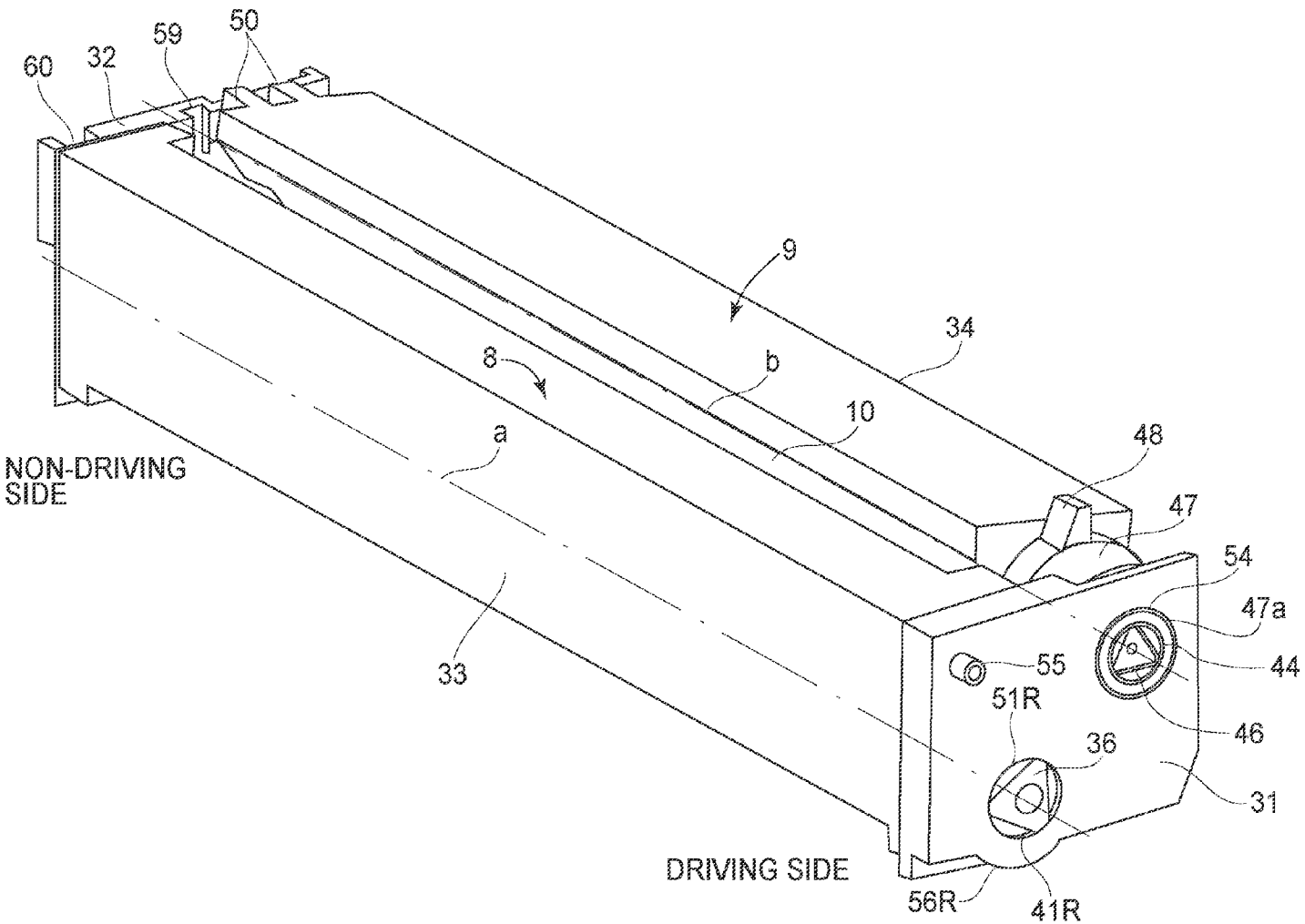
FIG. 21 is a perspective view of the cartridge, the developer storage chamber of which has been unsealed, as seen from the side from which the cartridge is driven.

Next, the user is to carry out the operation for removing the sealing member 43 to allow the toner T in the toner storage chamber 39 of the development unit 9 to be supplied to the development chamber 40 of the development unit 9. The operation for removing the sealing member 43 is as follows: First, the user is to hook or grasp the actual tab portion 61*c* of the pull-tab 61 with his finger, and then, to pull the sealing member 43 (tab portion 61*c*) in the direction indicated by an arrow mark n (lengthwise direction of sealing member 43) as shown in FIG. 19. As the sealing member 43 (tab portion 61*c*) is pulled, the portion of the sealing member 43, which was welded to the edges of the opening of the toner outlet 43 is gradually peeled from the lengthwise end on the toner outlet 43, which is on the side from which the cartridge P is driven, toward the opposite end of the toner outlet 43, that is, the end of the toner outlet 43, which is on the side from which the cartridge P is not driven, gradually unsealing the toner outlet 43 from the lengthwise end on the toner outlet 43, which is on the side from which the cartridge is driven, toward the opposite end of the toner outlet 43. Eventually, the entirety of the sealing member 43 will come out of the cartridge P. As a result, the entirely of the toner outlet 43 becomes unsealed, making it possible for the toner T in the toner storage chamber 39 to be supplied to the development chamber 40, as shown in FIG. 20. FIG. 21 is a perspective view of the cartridge P (as seen from the side from which the cartridge is driven), the developer storage chamber of which has been unsealed by pulling out the entirety of the sealing member 43.

Incidentally, it is the drum unit 8 that is to be held (grasped) by the user when the user pulls the sealing member 43 to remove the sealing member 43. The development unit 9 and the drum unit 8 are connected to each other in a manner to allow them to rotationally move relative to each other. Therefore, as soon as the actual tab portion 61*c* is placed in the upright position relative to the top surface of the development unit 9, and therefore, development unit locking projection 61*d* is disengaged, while the drum unit 8 is held by the user, the development unit 9 is allowed to change in attitude, that is, allowed to rotationally move about the axial line 62. An arrow mark J in FIGS. 18 and 19 shows this direction in which the development unit 9 is allowed to change in attitude.

Figure 18:
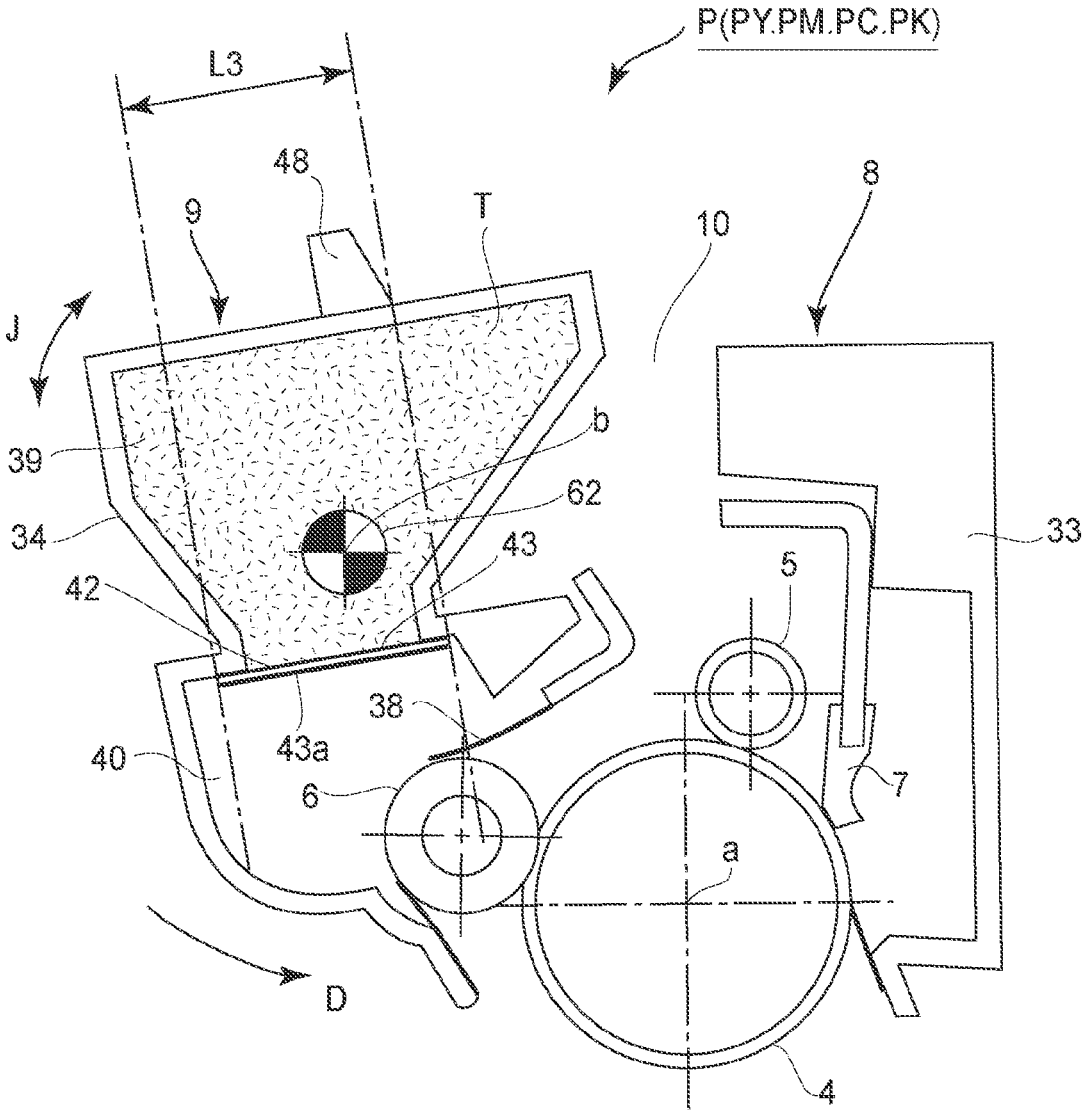
FIG. 18 is a schematic cross-sectional view of the process cartridge, the development unit of which has been freed from the locking member for preventing the rotational movement of the development unit, and the development roller and drum of which are in contact with each other.

However, the structure of the cartridge P is such that in terms of the direction perpendicular to the plane of the opening of the toner outlet 42 which is remaining sealed with the sealing member 43 (that is, direction perpendicular to sealing member 43), the aforementioned axis 62 of the rotational oscillatory movement of the development unit 9 falls within the range L3, which corresponds to the width of the sealing member 43 (FIG. 18). Therefore, the cartridge P in this embodiment is significantly smaller in the moment, which is generated in the direction to rotationally move the development unit 9 about the axis of its rotational movement when the sealing member is pulled, than a cartridge in accordance with the prior art. Therefore it is significantly smaller than a cartridge in accordance with the prior art, in the amount of change in attitude which occurs when the sealing member is pulled. Thus, it is ensured that the cartridge P in this embodiment remains stable when a user pulls the sealing member 43.

After the sealing member 43 is removed as described above, the cartridge P is to be placed in the cartridge tray 29 which is in its outermost position. Then, the cartridge tray 29 is to be pushed into the apparatus main assembly 1A until it reaches the transitional position. Then, the door 3 is to be closed. As the door 3 is closed, the photosensitive drum 4 is accurately positioned relative to the apparatus main assembly 1A, and also, is fixed in attitude by the boss 55.

Figure 22:
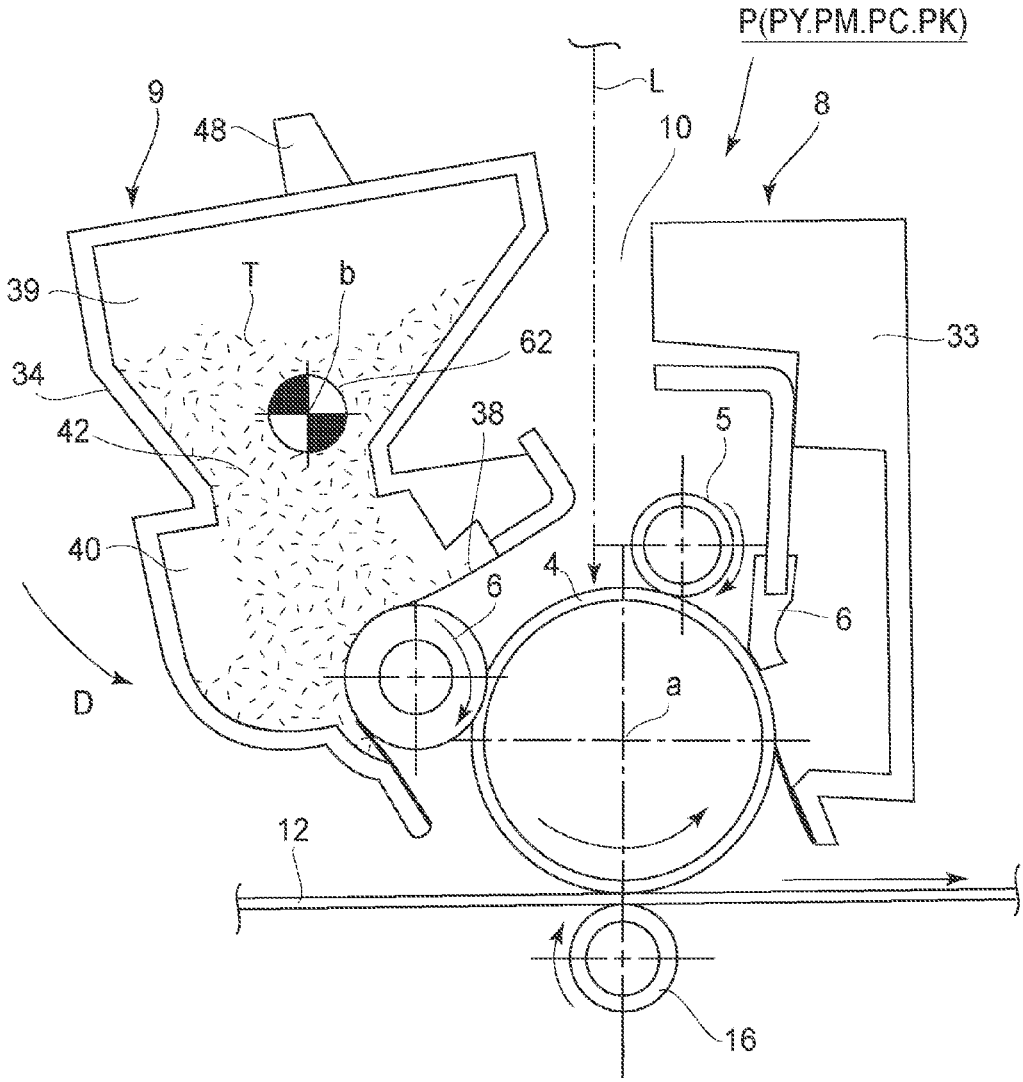
FIG. 22 is a schematic cross-sectional view of the process cartridge, which is being used for image formation, as seen from the left side of the cartridge.
Figure 23:
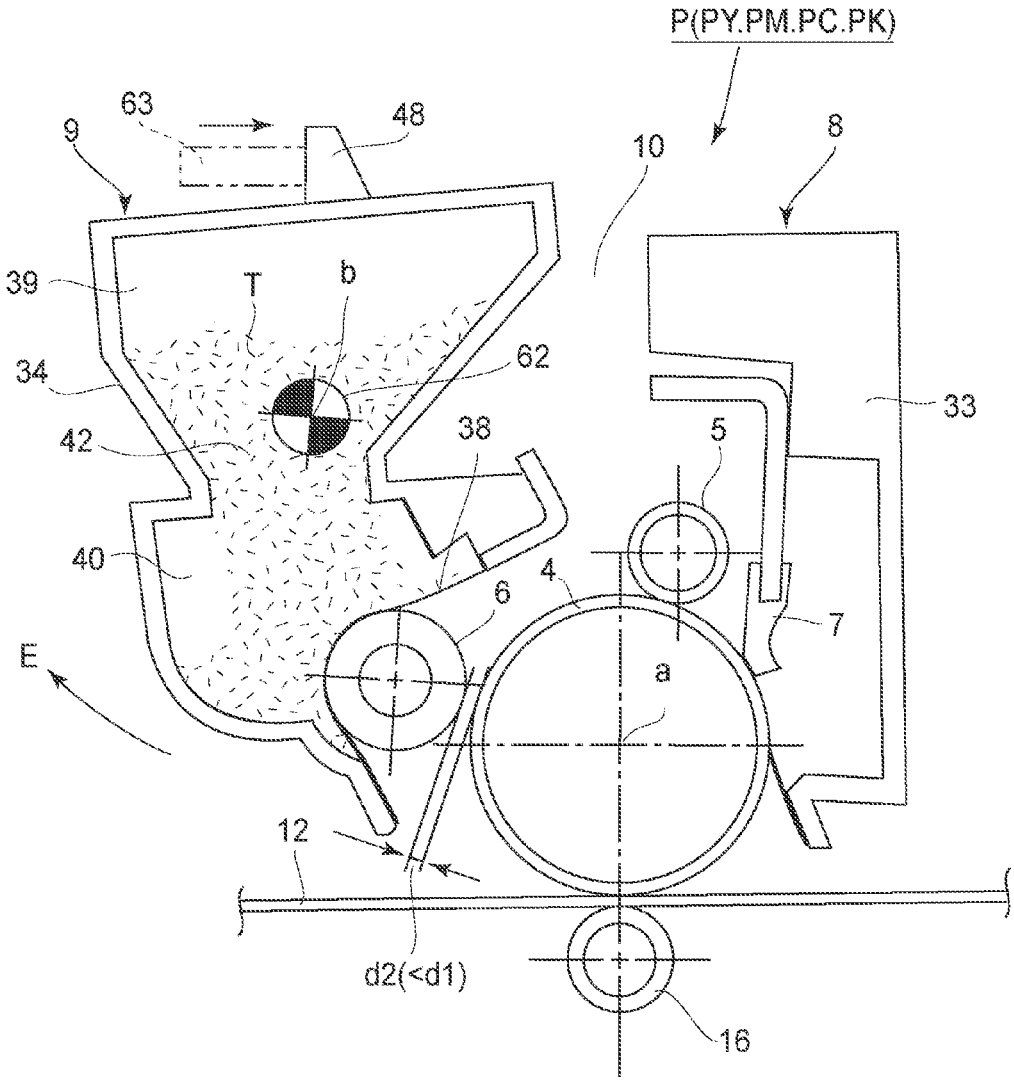
FIG. 23 is a schematic cross-sectional view of the process cartridge, which is not being used for image formation, as seen from the left side of the cartridge.

While the image forming apparatus 1 is performing an image forming operation, the photosensitive drum 4 and the development roller 6 are kept in contact with each other, and are rotationally driven at their preset velocities, in the counterclockwise and clockwise directions, respectively, indicated in FIG. 22.

While the image forming apparatus 1 is not performing an image forming operation (while image is not formed), the separation rib 48 of the development unit 9 is rotationally moved about the axis 62 of the rotational movement of development unit 9 in the clockwise direction (indicated by arrow mark E), by the pressure applied by the pressing member 64 of the apparatus main assembly 1A, against the resiliency of the pair of compression springs. Therefore, the development roller 6 is kept separated by the distance d2 from the photosensitive drum 4. The distance d2 is smaller than the distance d1 which is provided between the development roller 6 and photosensitive drum 4 of a brand-new cartridge P. As soon as an image forming operation is started, the pressing member 64 is moved away from the separation rib 48, allowing thereby the development roller 6 to be placed in contact with the photosensitive drum 4. In other words, the development unit 9 is moved back into the position in which it keeps the development roller 6 in contact with the photosensitive drum 4.

Embodiment 2

Figure 24:
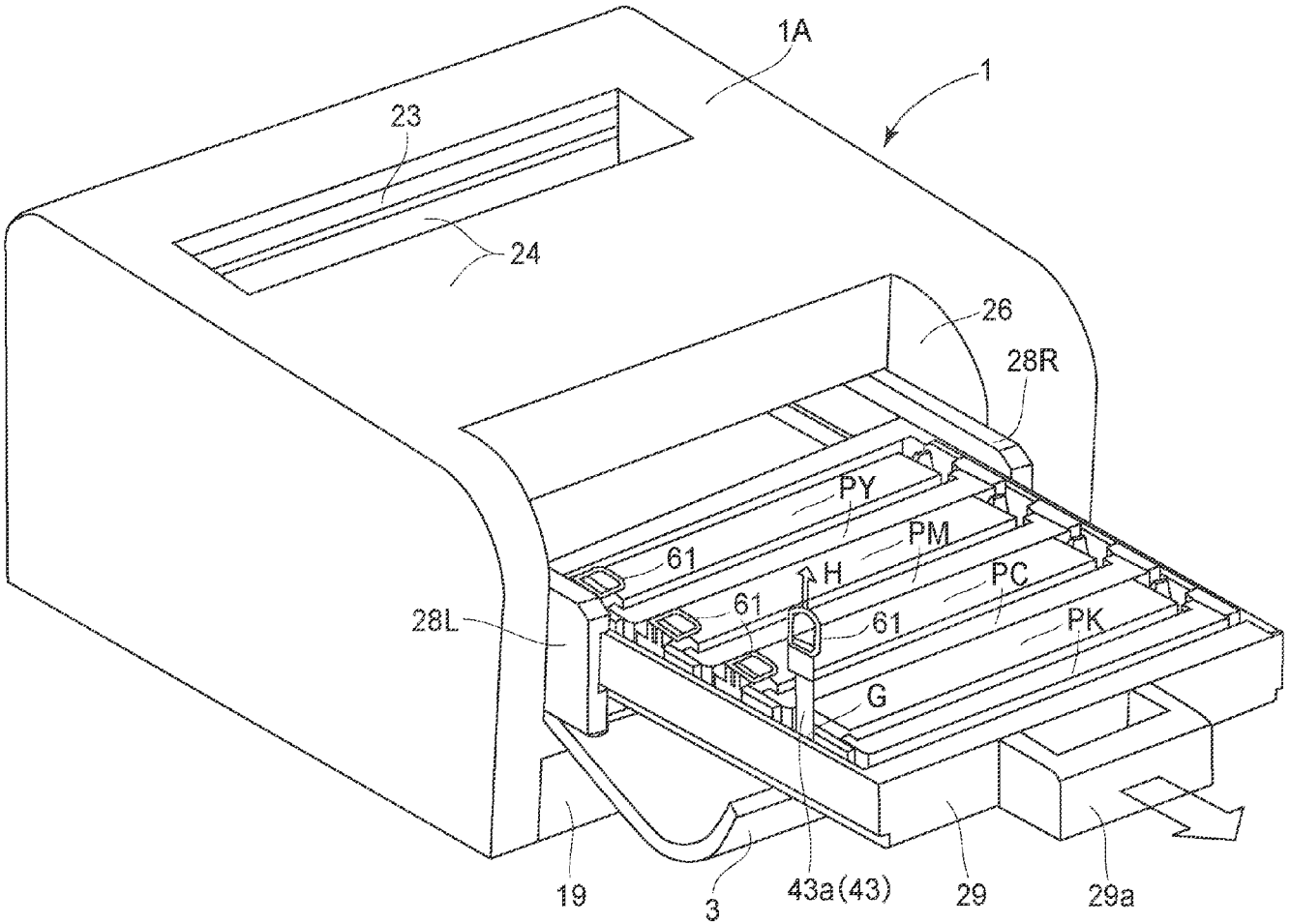
FIG. 24 is a perspective view of the image forming apparatus in the second embodiment of the present invention.

Next, referring to FIG. 24, a case in which the sealing member 43 of a brand-new cartridge P is removed while the cartridge P is in the image forming apparatus 1 will be described. In this case, a user is to perform the following sequence to remove the sealing member 43 to ready the image forming apparatus 1 for image formation.

First, the user is to open the door 3 of the image forming apparatus 1 and pull out the cartridge tray 29 to the position in which the cartridges P (PY, PM, PC, and PK) can be mounted or removed.

Even when the cartridge tray 29 is in the abovementioned position, the cartridges P remain supported by the cartridge tray 29. The portion of the sealing member 43, which is extending from each cartridge P, through the sealing member removal slot in the end wall of the cartridge P, is upwardly bent by 90° at the outward edge of the sealing member removal slot, and is made to extend upward through the gap between the lengthwise end wall of the cartridge P, which is on the side from which the cartridge P is not driven, and the cartridge tray 29. The outward end of the sealing member 43 is attached to the pull-tab 61 as it is in the first embodiment. The pull-tab 61 in this embodiment is the same as the one in the first embodiment, and is attached to the lengthwise end wall of the cartridge P, which is on the side from which the cartridge P is not driven, as is the pull-tab 61 in the first embodiment. That is, the pull-tab 61 in this embodiment is also bent by roughly 90° at the hinge portion 61*b* so that the actual tab portion 61*c* lies flat on the top surface of the cartridge P.

A user is to unlock the actual tab portion 61*c* of the pull-tab 61 from the cartridge P and pull the sealing member 43 (tab portion 61*c*) upward (direction indicated by arrow mark H) while keeping the cartridge P in the cartridge tray 29. That is, the sealing member 43 is to be pulled in the upstream direction in terms of the direction in which the cartridge P is mounted into the cartridge tray 29. Further, for the purpose of providing the space G, the cover 32 of the cartridge P is provided with a recess 32*a* (FIG. 19), which is recessed in the direction parallel to the axial line of the development roller 6.

As the pull-tab 61 is pulled as described above, it comes out while sliding on the outward surface of the end wall of the cartridge P. Since the development unit 9 is held to the drum unit 8 so that it is allowed to rotationally move relative to the drum unit 8, the development unit 9 is allowed to change in attitude.

However, also in this embodiment, the structure of the process cartridge P is such that in terms of the direction perpendicular to the plane of the opening of the toner outlet 42 which is remaining sealed with the sealing member 43 (that is, direction perpendicular to sealing member 43), the aforementioned axis 62 of the rotational oscillatory movement of the development unit 9 falls within the range L3, which corresponds to the width of the sealing member 43 (FIG. 18). Therefore, the cartridge P in this embodiment is significantly smaller in the moment, which is generated in the direction to rotationally move the development unit 9 about the axis of its rotational movement when the sealing member is pulled, than a cartridge in accordance with the prior art. Therefore it is significantly smaller than a cartridge in accordance with the prior art, in the amount of change in attitude which occurs when the sealing member is pulled. Thus, it is ensured that the cartridge P in this embodiment remains stable when a user pulls the sealing member 43.

Embodiment 3

This embodiment also relates to a case in which the sealing member 43 of a brand-new cartridge P is removed while the cartridge P is in the image forming apparatus 1, as does the first embodiment.

Figure 25:
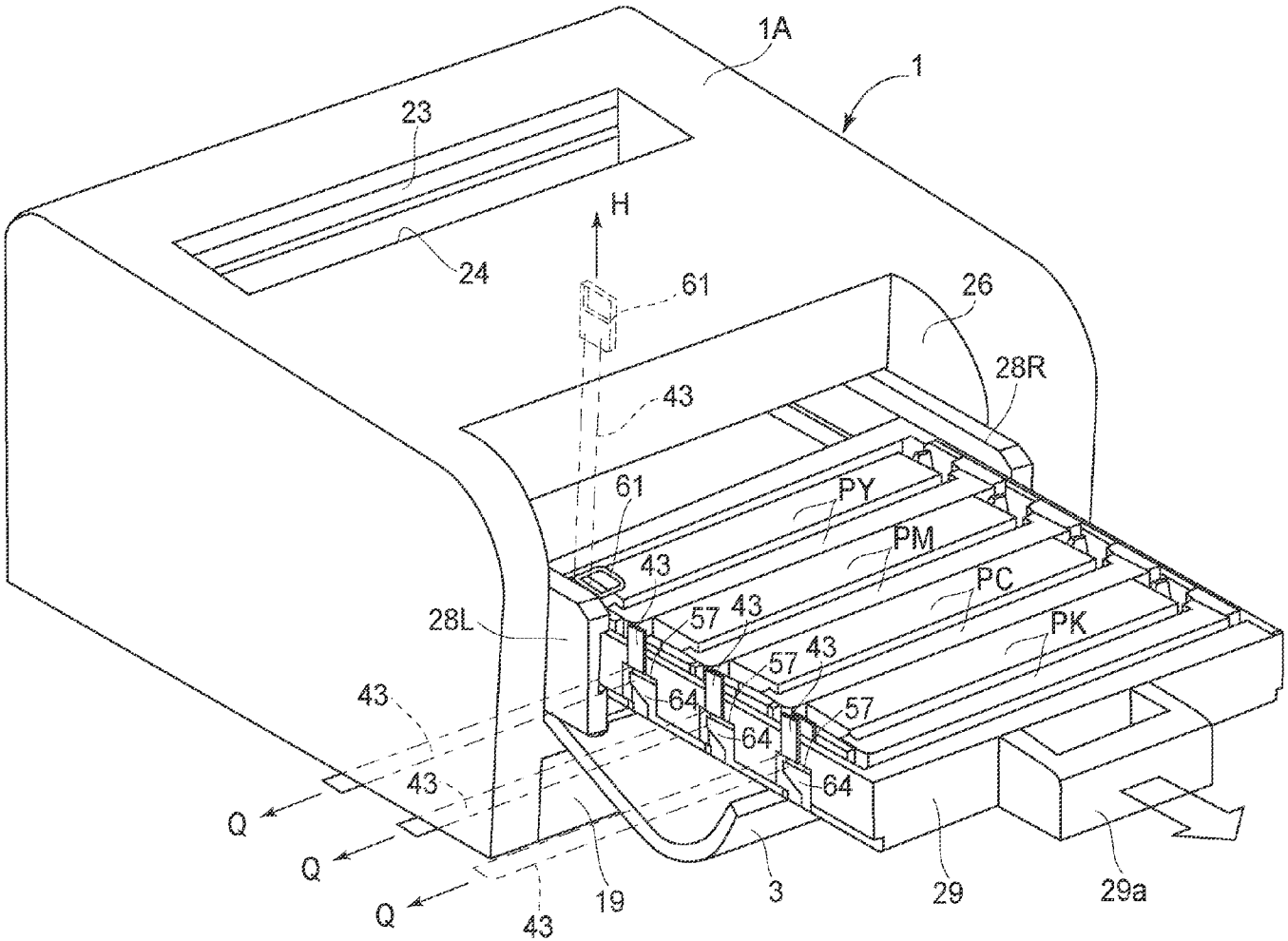
FIG. 25 is a perspective view of the image forming apparatus in the third embodiment of the present invention.

FIG. 25 is a perspective view of the image forming apparatus in the third embodiment of the present invention, the cartridge tray 29 of which is in the outermost position relative to the apparatus main assembly 1A, as seen from the side from which the cartridge P is not driven. In this embodiment, the end wall of cartridge tray 29, which is on the side from which the cartridge P is not driven, is provided with holes 64, which are for exposing the sealing member removal slot 57 of each of the second to fourth cartridges PM, PC, and PK in the cartridge tray 29. The portion of the end wall of the cartridge tray 29, which corresponds to the first cartridge (PY) is not provided with the hole 64 for exposing the sealing member removal slot 57, because even when the cartridge tray 29 is in the outermost position, there are the cartridge supporting members 28L and 28R next to the outward surface of the portion of the end wall of the cartridge 29, which corresponds to the first cartridge (PY).

Each of the second to fourth cartridges PM, PC, and PK in this embodiment are structured as follows: the portion of the sealing member 43, which is extending from the cartridge P, is extended to the outer edge of the hole 64 of the cartridge tray 29, is changed by 90° in direction at the outer edge of the hole 64, that is, stretched upward from the outer edge of the hole 64, along the lateral end wall of the cartridge tray 29, so that it can be laid on the top surface of the cartridge tray 29. In this case, the portion of the sealing member, which is extending from the cartridge P, is positioned as described above after the cartridges PM, PC, and PK are mounted in the cartridge tray 29 when the image forming apparatus 1 is shipped.

The first cartridge, that is, the cartridge PY, is the same in structure as the cartridges P in the first and second embodiments. That is, the portion of the sealing member 43, which is extending from each cartridge P, through the sealing member removal slot in the end wall of the cartridge P, is upwardly bent by 90° at the outward edge of the sealing member removal slot, and is made to extend upward through the gap between the lengthwise end wall of the cartridge P, and the cartridge tray 29. The outward end of the sealing member 43 is attached to the pull-tab 61. The pull-tab 61 in this embodiment is attached to the lengthwise end wall of the cartridge P, and is placed in the space between the lengthwise end wall of the cartridge P, which is on the side from which the cartridge is not driven, and the cartridge tray 29. It is also bent by roughly 90° at the hinge portion 61*b* so that the actual tab portion 61*c* lies flat on the top surface of the cartridge P.

A user is to perform the following sequence to remove the sealing member 43 to ready the image forming apparatus 1 for image formation.

First, a user is to open the door 3 of the image forming apparatus 1 and pull out the cartridge tray 29 to the position in which the cartridges P can be mounted or removed. Next, in the case of the second to fourth cartridges, that is, the cartridges PM, PC, and PK, the user is to pull their sealing member 43 in the lengthwise direction of the sealing member 43 (direction indicated by arrow mark q in drawing) while keeping the cartridges held in the cartridge tray 29. In the case of the first cartridge, the user is to unlock the pull-tab 61 from the cartridge P, and then, pull upward the sealing member 43 while keeping the cartridge P held in the cartridge tray 29, as is the pull-tab 61 of the cartridge P in the second embodiment.

Since the development unit 9 is held to the drum unit 8 in such a manner that the disengagement of the actual tab portion 61*c* of the pull-tab 61 allows the former to rotationally move relative to the latter, as soon as the actual tab portion 61*c* is unlocked from the cartridge P, the development unit 9 is allowed to change in attitude.

However, the cartridge P in this embodiment is also structured so that in terms of the direction perpendicular to the plane of the opening of the toner outlet 42 remaining sealed with the sealing member 43 (that is, in terms of direction perpendicular to sealing member 43), the axial 62 of the rotational movement of the development unit 9 is falls within the range L3 of the sealing member 43 in the widthwise direction of the sealing member 43 (FIG. 18). Therefore, the cartridge P in this embodiment is significantly smaller in the moment, which is generated in the direction to rotationally move the development unit 9 about the axis of its rotational movement when the sealing member is pulled, than a process cartridge in accordance with the prior art. Therefore it is significantly smaller than a process cartridge in accordance with the prior art, in the amount of change in attitude which occurs when the sealing member is pulled. Thus, it is ensured that the cartridge P in this embodiment remains stable when a user pulls the sealing member 43.

In the first to third embodiments, the image forming apparatus 1 was an image forming apparatus which employs four cartridges P (PY, PM, PC, and PK). However, these embodiments were not intended to limit the present invention in scope. For example, the present invention is also effectively applicable to a full-color image forming apparatus which use only three color toners, for example, yellow, magenta, and cyan toners, and a monochromatic image forming apparatus which uses only a black toner.

EFFECTS OF INVENTION

The present invention can improve a process cartridge in operability, in particular, in terms of the efficiency with which the sealing member can be removed. That is, the present invention makes it possible to keep stable the development unit of a process cartridge in attitude when the sealing member of a process cartridge has to be removed while the cartridge is not in an image forming apparatus. Therefore, the present invention ensures that the sealing member is properly removed.

Further, the present invention makes it possible to keep stable the development unit of a process cartridge stable in attitude even when the sealing member of the process cartridge is removed while the process cartridge is in an electrophotographic image forming apparatus. Therefore, the present invention ensures that the sealing member is properly removed.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 102602/2007 filed Apr. 10, 2007, which is hereby incorporated by reference.

What is claimed is:

1. A process cartridge detachably mountable to a main assembly of an electrophotographic image forming apparatus, said process cartridge comprising:

a drum unit having an electrophotographic photosensitive drum; and a developing unit rotatably connected with said drum unit at a center of rotation, said developing unit including a developing roller that develops an electrostatic latent image formed on said electrophotographic photosensitive drum with a developer, a developer accommodating portion accommodating the developer, a supply opening, extending in an axial direction of said developing roller, that supplies the developer to said developing roller from said developer accommodating portion, and a sealing member sealing said supply opening, wherein said supply opening is unsealable by pulling and removing said sealing member in the axial direction, wherein the center of rotation is within a width of said sealing member with respect to a direction perpendicular to the axial direction, as seen in a direction perpendicular to a surface of said sealing member.

2. A process cartridge according to claim 1, further comprising a covering member rotatably connecting said developing unit to said drum unit at each of one and the other ends with respect to the axial direction.

3. A process cartridge according to claim 2, wherein one of said covering members is provided with an opening for being passed by said sealing member to remove said sealing member.

4. A process cartridge according to claim 1, further comprising an urging member contacting said developing roller and said electrophotographic photosensitive drum to each other.

5. A process cartridge according to claim 1, wherein said developing unit includes a developer chamber provided with the developing roller, and wherein said supply opening is disposed between said developer accommodating portion and said developer chamber.

6. A process cartridge according to claim 1, further comprising a covering member rotatably connecting said developing unit to said drum unit at one end with respect to the axial direction, wherein said sealing member is provided, at one end of said sealing member with respect to the axial direction, with a grip portion for being gripped when said sealing member is removed, said grip portion including a space retaining portion engaged with said developing unit and said covering member to retain said developing unit in the spaced position.

7. A process cartridge according to claim 1, wherein said sealing member is foldable back at the other end with respect to the axial direction to permit removal thereof from one end with respect to the axial direction.

8. A process cartridge according to claim 7, wherein said sealing member is welded to a developing container having the supply opening, around the supply opening.

9. An electrophotographic image forming apparatus for forming an image on a recording material, said electrophotographic image forming apparatus comprising:

(a) a process cartridge detachably mounted to a main assembly of said electrophotographic image forming apparatus, said processing cartridge comprising:

a drum unit having an electrophotographic photosensitive drum; and a developing unit rotatably connected with said drum unit at a center of rotation, said developing unit including a developing roller that develops an electrostatic latent image formed on said electrophotographic photosensitive drum with a developer, a developer accommodating portion accommodating the developer, a supply opening, extending in an axial direction of said developing roller, that supplies the developer to said developing roller from said developer accommodating portion, and a sealing member sealing said supply opening, wherein said supply opening is unsealable by pulling and removing said sealing member in the axial direction, wherein the center of rotation is within a width of said sealing member with respect to a direction perpendicular to the axial direction, as seen in a direction perpendicular to a surface of said sealing member; and (b) means for feeding the recording material.

10. An apparatus according to claim 9, further comprising a movable member movably supporting said process cartridge, wherein said movable member is capable of taking a mounting position, in said main assembly of the apparatus, for moving said process cartridge to a position where an image forming operation is possible, and a retracted position, outside said main assembly of the apparatus, for permitting dismounting of said process cartridge, wherein said sealing member is removable in a state in which said movable member supports said process cartridge in the retracted position.

11. An apparatus according to claim 10, wherein a gap is provided between said movable member and said process cartridge for permitting said sealing member to be drawn and removed in an upstream direction, upstream with respect to a mounting direction in which said process cartridge is mounted to said movable member, in the state in which movable member supports said process cartridge.

12. An apparatus according to claim 11, wherein said process cartridge is provided with a recess which is recessed in the axial direction to provide the gap.

13. An apparatus according to claim 10, wherein said movable member is provided with an opening for permitting removal of said sealing member in the axial direction in the state in which movable member supports said process cartridge.

14. An apparatus according to claim 10, wherein said movable member supports a plurality of said process cartridges.

* * * * *